United States Patent [19]

Ikeda et al.

[11] Patent Number: 4,971,889

[45] Date of Patent: Nov. 20, 1990

[54] SILVER HALIDE PHOTOGRAPHIC EMULSIONS

[75] Inventors: Tadashi Ikeda; Haruo Takei; Satoru Takimoto; Masaki Okazaki, all of Kanagawa, Japan

[73] Assignee: Fuji Photo Film Co., Ltd., Kanagawa, Japan

[21] Appl. No.: 402,196

[22] Filed: Sep. 1, 1989

[30] Foreign Application Priority Data

Sep. 1, 1988 [JP] Japan ..... 63-219191
Sep. 1, 1988 [JP] Japan ..... 63-219192

[51] Int. Cl.[5] ..... G03C 1/10

[52] U.S. Cl. ..... 430/264; 430/570; 430/573; 430/576; 430/578; 430/591; 430/599; 430/600; 430/603

[58] Field of Search ..... 430/264, 570, 573, 576, 430/578, 591, 599, 600, 603

[56] References Cited

U.S. PATENT DOCUMENTS 4,746,601 5/1988 Mihayashi et al. ..... 430/600
4,800,154 1/1989 Okazaki et al. ..... 430/570

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A silver halide photographic emulsion containing at least one compound represented by following formula (I):

Dye—L—Hyd (I)

wherein Dye represents a chromophore-containing dye residue shown by following formula (II); Hyd represents a hydrazine residue one of the two nitrogen atoms of which is substituted by a carbonyl group, a sulfonyl group, a sulfoxy group, a phosphoryl group, or an alkilydene group and L represents a divalent linkage group of bonding Dye and Hyd;

(II)

wherein R and $R_1$, which may be the same or different, each represents an alkyl group; Z and $Z_1$, which may be the same or different, each represents an atomic group necessary for forming a 5- or 6-membered heterocyclic ring; Q represents an atomic group necessary for forming a 5- or 6-membered carbon ring or a 5- or 6-membered heterocyclic ring; A represents an oxygen atom or a sulfur atom; and n, d, and m each represents 0 or 1.

14 Claims, 1 Drawing Sheet

SILVER HALIDE PHOTOGRAPHIC EMULSIONS

FIELD OF THE INVENTION

This invention relates to a silver halide photographic emulsion, and more particularly to a silver halide photographic emulsion containing a spectral sensitizing dye having a hydrozine derivative as a substituent.

FIELD OF THE INVENTION

A technique for the spectral sensitization in silver halide photography is known as a means for expanding the light-sensitive wavelength region of a silver halide photographic emulsion from the intrinsic sensitivity region of the silver halide to a longer wavelength sinde and is an important technique in photographic fields. The light-sensitive wavelength region can be almost optionally adjusted to an infrared wavelength region by selecting the structure of a sensitizing dye for the required purpose.

However, the desirement for silver halide photographic emulsions having a higher sensitivity has been more and more increased and various efforts have been done for increasing the sensitivity of silver halide emulsions.

Under such a circumstance, the development of new sensitizing dyes capable of giving a higher spectral sensitivity has, as a matter of course, been desired.

As one of the ways of thinking for developing sensitizing dyes capable of giving a higher spectral sensitivity, there is a thinking way of increasing a light absorption coefficient and as the patents based on such a way of thinking, there are U.S. Pat. Nos. 3,622,317, 3,976,493, and 3,976,640.

As other way of thinking, there is an attempt of removing desensitizing factors caused by sensitizing dyes and based on such a way of thinking, various techniques such as supersensitization, etc., are known.

The supersensitization is a technique inevitable for obtaining a high spectral sensitization as a technique of not only reducing desensitizing factors but also increasing a spectral sensitizing effect. As examples of the excellent supersensitizing techniques, there are known the techniques using so-called holopolarcyanine dyes as described in U.S. Pat. Nos. 4,546,074 and 4,326,023.

However, since silver halide photographic materials having a higher sensitivity and a high quality have desired at present, more excellent supersensitizing techniques are desired.

Also, the desensitization factors include a development inhibition by sensitizing dye and as the counterplan to the occurrence of the development inhibition, it is proposed to use a development accelerator together with the sensitizing dyes.

However, ordinary spectral sensitizing dyes are lacking in the coexisting property with other components contained in a silver halide emulsion. Accordingly, even when a development accelerator is simply used together with such a sensitizing dye, the desired effect is not always obtained.

It is considered that the cause of lacking in the coexisting property is the competitive phenomenon of a sensitizing dye and other chemical component(s) for occupying a position on the surface of silver halide grains. As an intention of avoiding the occurrence of such a competitive phenomenon, JP-A-No. 47-9433 and JP-No. 47-9678 (the term "JP-A" as used herein means an "unexamined published Japanese patent application"), U.S. Pat. No. 3,718,470, and *Research Disclosure*, NO. 15162 (November, 1976) describe some concepts and compounds in regard to the relation between nucleating agents and sensitizing dyes. However, there are neither descriptions of suggesting the capability of avoiding the occurrence of the competitive phenomenon nor descriptions showing the capability of giving a higher spectral sensitivity than that by an ordinary sensitizing dye in these documents.

Also, JP-A-No. 62-89954 describes that a higher spectral sensitivity is obtained but it has been desired to obtain a far higher spectral sensitivity.

SUMMARY OF THE INVENTION

A first object of this invention is, therefore, to provide a novel sensitizing dyes giving a higher spectral sensitivity and a supersensitizing technique therefor.

A second object of this invention is to provide a silver halide photographic emulsion containing the aforesaid sensitizing dye(s) and capable of performing the aforesaid supersensitization.

As the result of various investigations for attaining the aforesaid objects, the investors have discovered that the aforesaid objects can be attained by using a compound represented by following formula (I) for a silver halide photographic emulsion;

$$\text{Dye—L—Hyd} \qquad \text{(I)}$$

wherein Dye represents a dye residue having a chromophore represented by formula (II) described below; Hyd represents a hydrazine residue one of two nitrogen atoms of which is substituted by a carbonyl group, a sulfonyl group, a sulfoxy group, a phosphoryl group, or an alkylidene group; and L represents a divalent linkage group of bonding Dye and Hyd;

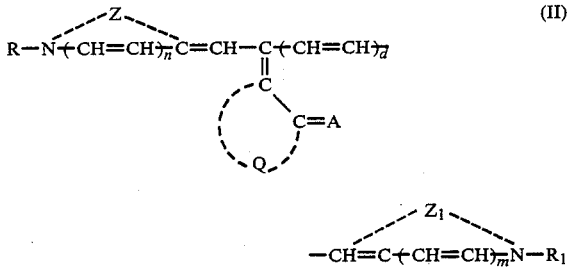

(II)

wherein R and $R_1$, which may be the same or different, each represents an alkyl group; Z and Z1 , which may be the same or different, each represents an atomic group necessary for forming a 5- or 6-membered ring; Q represents an atomic group necessary for forming a 5- or 6-membered carbon ring or a 5- or 6-membered heterocyclic ring; A represents an oxygen atom or a sulfur atom; and n, d, and m each represents 0 or 1.

Furthermore, it has further been discovered that the aforesaid objects of this invention can be effectively also attained by incorporating at least one compound represented by following formula (III) into the aforesaid silver halide photographic emulsion containing the compound of formula (I);

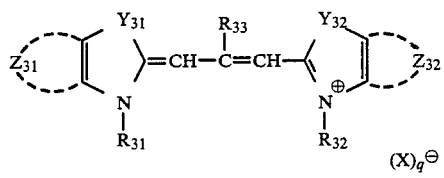

(III)

wherein $R_{31}$ and $R_{32}$, which may be the same or different, each represents an alkyl group; $R_{33}$ represents an alkyl group or an aryl group; $Z_{31}$ and $Z_{32}$, which may be the same or different, each represents an atomic group necessary for forming a benzene ring or a naphthalene ring; $Y_{31}$ and $Y_{32}$ each represents an oxygen atom, a sulfur atom, a selenium atom, or =N—$R_{34}$ (wherein $R_{34}$ represents an alkyl group); X represents an acid residue; and q represents a number necessary for balancing charges, when the compound of formula (III) forms an intramolecular salt, said q being 0.

DETAILED DESCRIPTION OF THE INVENTION

Figure 1:
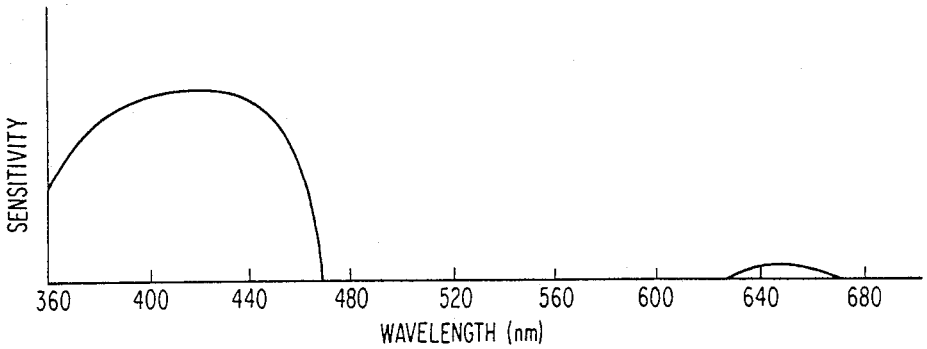
FIG. 1 is a graph showing spectral sensitivity curves corresponding to Test Nos. 1 to 3 in Example 1.
Figure 2:
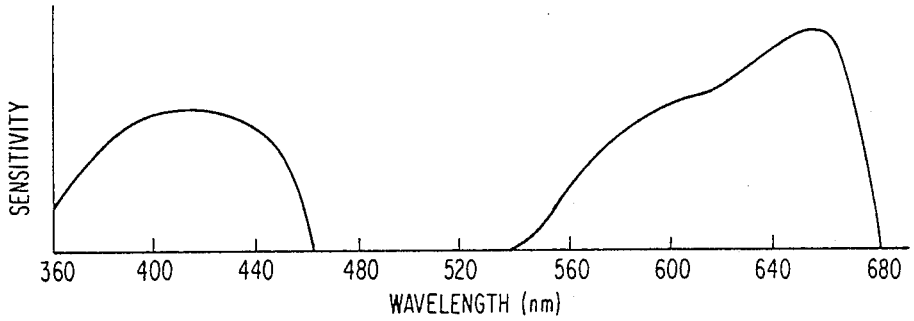
FIG. 2 is a graph showing spectral sensitivity curves corresponding to Test Nos. 1 to 12 in Example 1.

First, the compound of formula (I) (including formula (II)) explained in detail.

Thus, in formula (II) showing the chromophore-containing dye residue, examples of the 5- or 6-membered heterocyclic ring formed by Z and $Z_1$ are thiazole nuclei (e.g., thiazole, 4-methylthiazole, 4-phenylthiazole, 4,5-dimethylthiazole, 4,5-diphenylthiazole), benzothiazole (e.g., benzothiazole, 4-chlorobenzothiazole, 5-chlorobenzothiazole, 6-chlorobenzothiazole, 5,6-dimethoxybenzothiazole, 5-nitrobenzothiazole, 4-methylbenzothiazole, 5-methylbenzothiazole, 6-methylbenzothiazole, 5-bromobenzothiazole, 6-bromobenzothiazole, 5-indobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenetylbenzothiazole, 5-fluorobenzothiazole, 5-chloro-6-methylbenzothiazole, 5,6-dimethoxybenzothiazole, 5,6-dioxymethylenebenzothiazole, 5-acetylaminobenzothiazole, 5,6-dimethylbenzothiazole, 5-hydroxy-6-methylbenzothiazole, tetrahydrobenzothiazole, 4-phenylbenzothiazole), naphthothiazole nuclei (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, 8,9-dihydronaphtho[1,2-d]thiazole), thiazoline nuclei (e.g., thiazoline, 4-methylthiazoline, 4-nitrothiazoline), oxazole nuclei (e.g., oxazole, 4-methyloxazole, 4-nitrooxazole, 5-methyloxazole, 4-phenyloxazole, 4,5-diphenyloxazole, 4-ethyloxazole), benzoxazole nuclei (e.g., benzoxazole, 5-chlorobenzoxazole, 5-methylbenzoxazole, 5-bromobenzoxazole, 5-fluorobnenzoxazole, 5-phenylbenzoxazole, 5-methoxybenzoxazole, 5-nitrobenzoxa zole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), naphthoxazole nuclei (e.g., naphtho[2,1-d]oxazole, naphtho[1,2-d]oxazole, naphtho[2,3-d]oxazole, 6-nitronaphtho[2,1-d]oxazole), oxazoline nuclei (e.g., 4,4-dimethyloxazoline), selenazole nuclei (e.g., 4-methylselenazole, 4-nitroselenazole, 4-phenylselenazole), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole), naphthoselenazole nuclei (e.g., naphtho[2,1-d]selenazole, naphtho[1,2-d]selenazole), 3,3-dialkylindolenine nuclei (e.g, 3,3-dimethylindolenine, 3,3-diethylindolenine, 3,3-dimethyl-5-cyanoindolenine, 3,3-dimethyl-6-nitroindolenine, 3,3=dimethyl-5-nitroindolenine, 3,3-dimethyl-5-methoxyindolenine, 3,3,5-trimethylindolenine, 3,3-dimethyl-5-chloroindolenine), imidazole nuclei (e.g., 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-alkylnaphtho[1,2-d]imidazole, 1-allyl-5,6-dichlorobenzimidazole, 1-allyl-5-chlorobenzimidazole, 1-arylimidazole, 1-arylbenzimidazole, 1-aryl-5-chlorobenzimidazole, 1-aryl-5,5-dichlorobenzimidazole, 1-aryl-5-methoxybenzimidazole, 1-aryl-5-cyanobenzimidazole, 1-arylnaphtho[1,2-d]imidazole (in the aforesaid compounds, the alkyl group is preferably an unsubstituted alkyl group having from 1 to 8 carbon atoms (e.g., methyl, ethyl, propyl, isopropyl, butyl) or a hydroxyalkyl group (e.g., 2-hydroxyethyl, 3-hydroxypropyl), and is particularly preferably a methyl group or an ethyl group and the aryl group is a phenyl group, a halogen (e.g., chlorine)-substituted phenyl group, an alkyl (e.g., methyl)-substituted phenyl group, an alkoxy (e.g., methoxy)-substituted phenyl group) pyridine nuclei (e.g., 2-pyridine, 4-pyridine, 5-methyl-2-pyridine, 3-methyl-4-pyridine), quinoline nuclei (e.g., 2-quinoline, 3-methyl-2-quinoline, 5-ethyl-2-quinoline, 6-methyl-2-quinoline, 6-nitro-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline, 6-nitro-3-isoquinoline), imidazo[4,5-b]quinoxaline nuclei (e.g., 1,3-diethylimiazo[4,5-b]quinoxaline, 6-chloro-1,3-diallylimidazo[4,5-b]quinoxaline), oxadiazole nuclei, thiadiazole nuclei, tetrazole nuclei, and pyrimidine nuclei.

Examples of the 5- or 6-membered ring formed by Q in formula (II) are rhodanine nuclei, 2-thiohydantoin nuclei, 2-thioxoozolidin-4-one nuclei, 2-pyrazolin-5-one nuclei, barbituric acid nuclei, 2-thiobarbituric acid nuclei, thiazolidine-2,4-dione nuclei, thiazolidon-4-one nuclei, isooxazolone nuclei and hydantoin nuclei as a 5- or 6-membered heterocyclic ring and indadipone nuclei as a 5- or 6-membered carbon ring.

Examples of the 5-membered or 6-membered heterocyclic ring formed by Z and $Z_1$ in formula (II) are preferably thiazole nuclei and particularly preferably at least one of them is a naphtho[1,2-d]thiazole nucleus.

The 5- or 6-membered ring formed by Q is particularly preferably a burbituric acid nucleus.

Also, examples of the alkyl group shown by R and $R_1$ in formula (II) are alkyl groups having from 1 to 18 carbon atoms, more preferably from 1 to 7 carbon atoms, and particularly preferably from 1 to 4 carbon atoms, such as unsaturated alkyl groups (e.g., methyl, ethyl, propyl, isopropyl, butyl, isobutyl, hexyl, octyl, dodecyl, octadecyl) and substituted alkyl groups such as an aralkyl group (e.g., benzyl, 2-phenylethyl, p-sulfo-2-phenetyl), a hydroxyalkyl group (e.g., 2-hydroxyethyl, 3-hydroxypropyl), a carboxyalkyl group (e.g., 2-carboxyethyl, 3-carboxypropyl, 4-carboxypropyl, carboxymethyl), an alkoxyalkyl group (e.g., 2-methoxyethyl, 2-(2-methoxyethoxy)ethyl), a sulfoalkyl group (e.g., 2-sulfoethyl, 3-sulfopropyl, 3-sulfobutyl, 4-sulfobutyl, 2-[3-sulfopropopropoxy]ethyl, 2-hydroxy-3-sulfopropyl, 3-sulfopropoxyethoxyethyl), a sulfatoalkyl group (e.g., 3-sulfatopropyl, 4-sulfatobutyl), and a heterocyclic ring-substituted alkyl group (e.g., 2-(pyrrolidin-2-on-1-yl)ethyl, tetrahydrofurfuryl), a 2-acetoxyethyl group, a carbomethoxymethyl group, a 2-methanesulfonylaminethyl group, and an allyl group).

As the hydrazine residue shown by Hyd in formula (I), a phenylhydrazine residue is preferred and one of the two nitrogen atoms thereof is substituted by, preferably a formyl group, an alkylcarbonyl group having from 1 to 5 carbon atoms, a benzoyl group, or an o-hydroxymethylbenzoyl group. The case that the nitrogen atom is substituted by a formyl group is more preferred. Thus, an N-formylphenylhydrazine residue is most preferred.

Examples of the divalent linkage group shown by L in formula (I) are

—O—, —$CH_2$—, —NH—, —CONH—, —NHCO—,

—$CH_2$CO—, 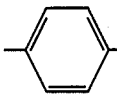 —CO—, 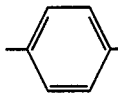 —COO—,

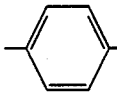 —CONH—, —$SO_2$NH—, —NH$SO_2$—, and

—NH(C=O)NH—.

In the aforesaid groups,

—CONH—, —$SO_2$NH—, and —NH(C=O)NH— are preferred.

Then, the compound of formula (III) for use in another embodiment of this invention is explained in detail.

In formula (III), examples of the benzene ring and naphthalene ring formed by each of $Z_{31}$ and $Z_{32}$ are benzene, methylbenzene, methoxybenzene, dimethylbenzene, dimethoxybenzene, carboxybenzene, phenylbenzene, chlorobenzene, bromobenzene, dichlorobenzene, dibromobenzene, acethylbenzene, cyanobenzene, trifluoromethylbenezene, chlorocyanobenzene, ethoxycarbonylbenzene, naphthalene, methylnaphthalene, and methoxynaphthalene.

The alkyl group shown by $R_{31}$, $R_{32}$ and $R_{34}$ in formula (III) have the same significance as that of R and $R_1$ in formula (II) described above. The aryl group shown by $R_{33}$ in formula (III) is a monocyclic aryl group containing not more then 8 carbon atoms (e.g., phenyl, tolyl, anisyl). Also, $R_{33}$ in formula (III) is, preferably, a methyl group, an ethyl group, a propyl group or a phenyl group, and is particularly preferably an ethyl group or a phenyl group.

X in formula (III) represents an acid residue. When X is a pair anion, examples thereof are halogen ions, methylsulfate ions, and 4-methylbenzenesulfonate ions and when X is a pair cation, examples thereof are sodium ions, potassium ions, triethylammonium ions, and pyridinium ions.

In the compound shown by formula (III), it is preferred that at least one of $Y_{31}$ and $Y_{32}$ represents a sulfur atom or a selenium atom and it is particularly preferred that both $Y_{31}$ and $Y_{32}$ are a sulfur atom or a selenium atom.

Then, specific examples of the compound shown by formula (I) and the compound shown by formula (III) are illustrated below but the scope of this invention is not limited to them.

I-1

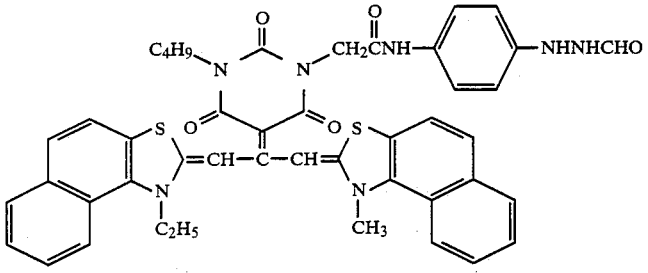

-continued
I-2
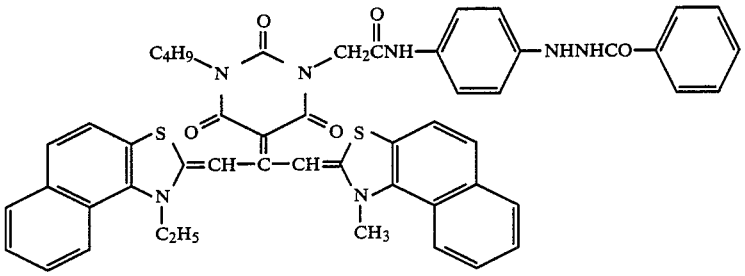
I-3
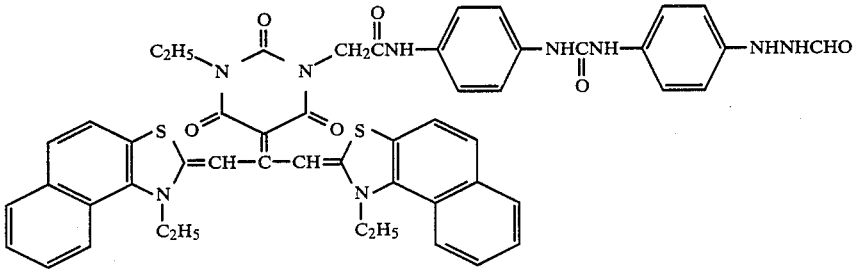
I-4
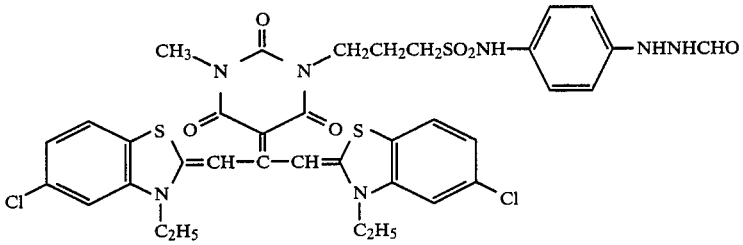
I-5
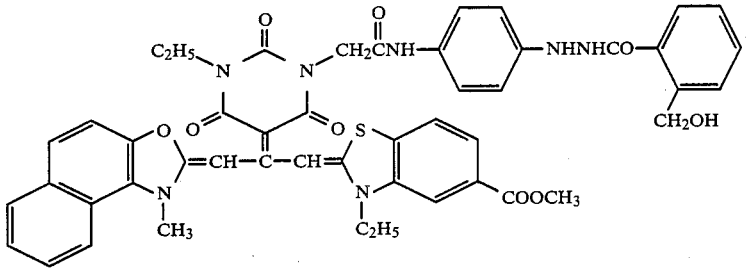
I-6
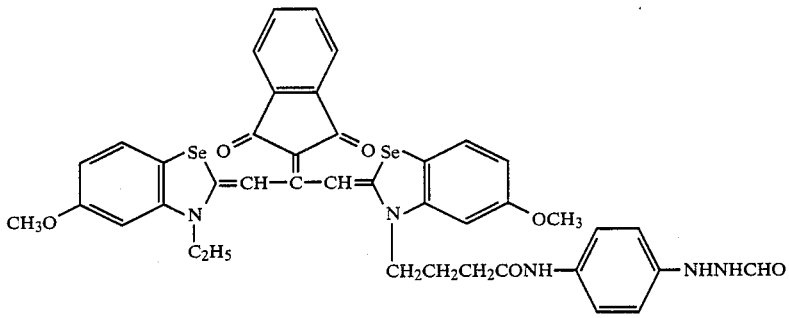

-continued
I-7
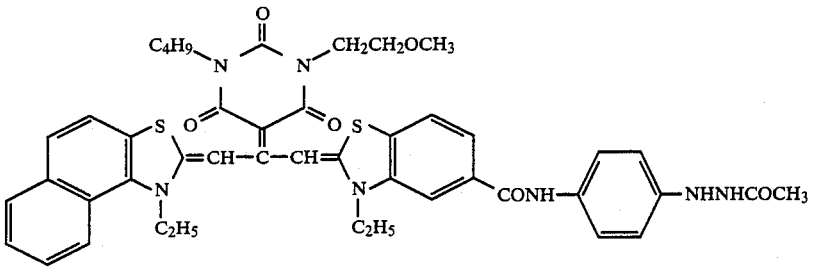
I-8
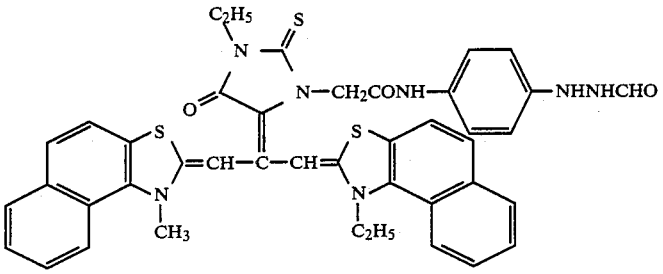
I-9
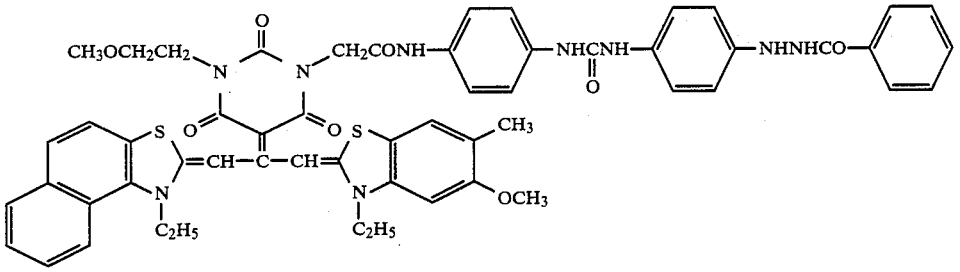
I-10
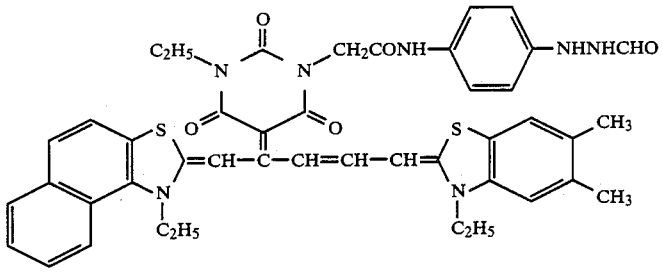
I-11
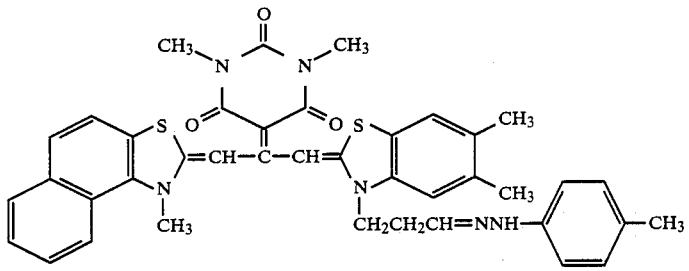

-continued
I-12
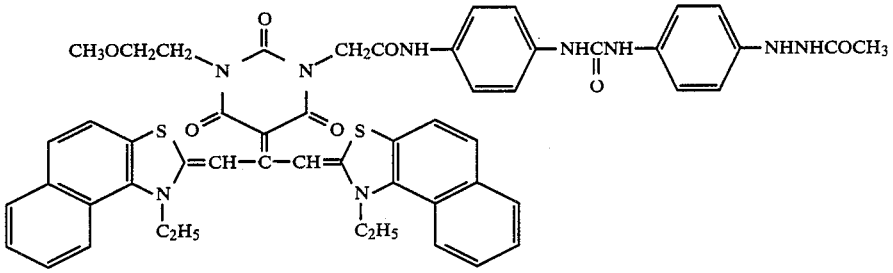
III-1
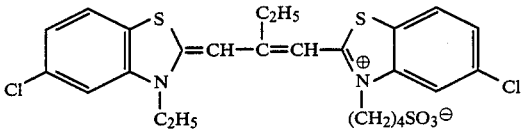
III-2
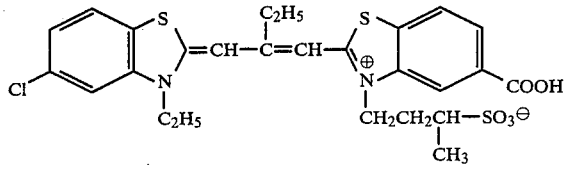
III-3
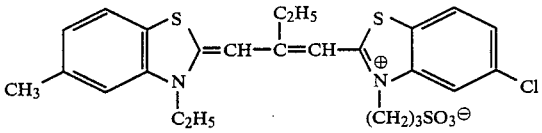
III-4
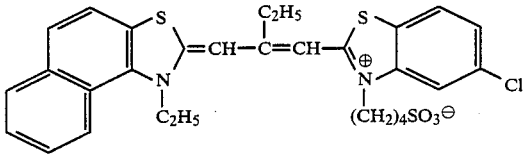
III-5
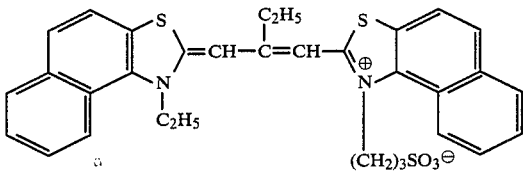
III-6
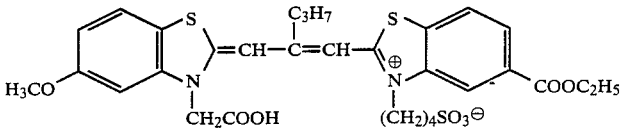
III-7
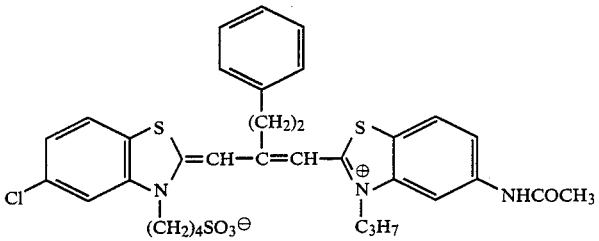

-continued
III-8
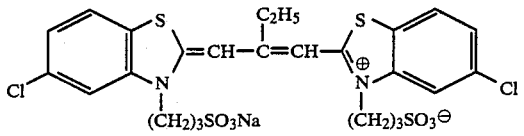
III-9
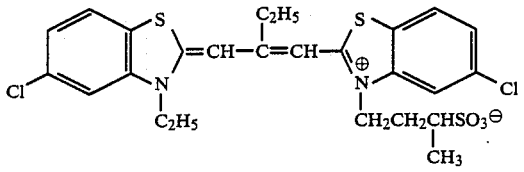
III-10
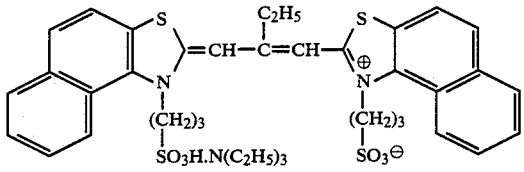
III-11
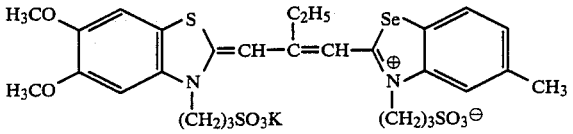
III-12
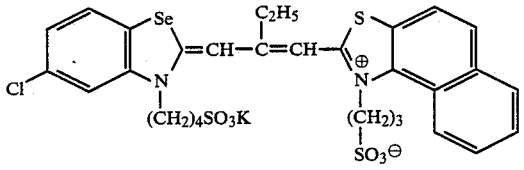
III-13
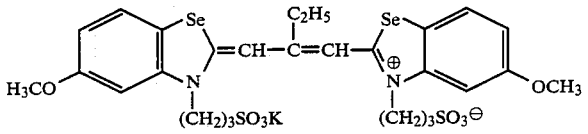
III-14
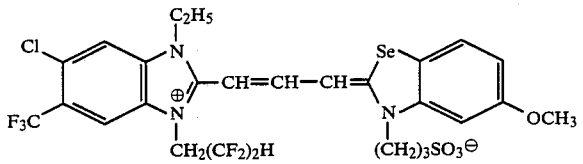
III-15
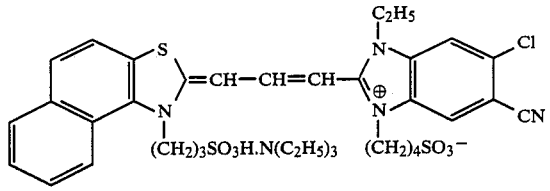
III-16
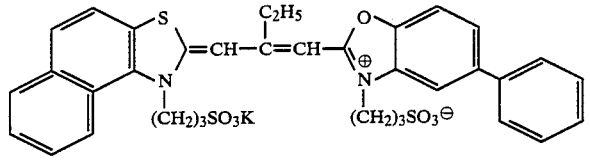

-continued

III-17

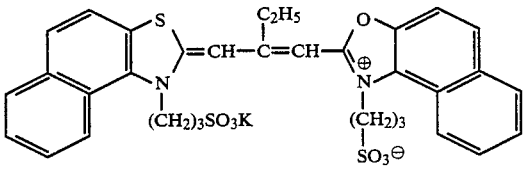

III-18

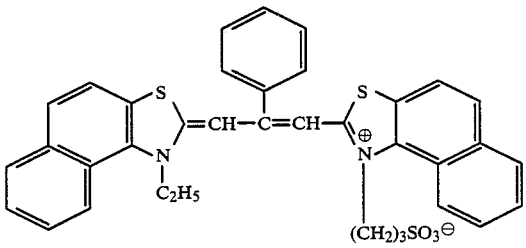

The compounds shown by formula (I) can be synthesized by a method of synthesizing the dye moieties (dye residues) shown by formula (II) and then bonding the dye moieties with a hydrazine moiety by an amide bond, etc., or a method of bonding a hydrazine moiety with the intermediates of the dye moieties shown by formula (II) and then converting the intermediates into dyes. Bonding of these moieties can be easily performed by referring to the description of S. R. Sandler and W. Karo, *Organic Functional Group Preparations,* published by Academic Publishers, 1968.

Also, the hydrazine derivative moieties for use in the synthesis of the compounds of formula (I) can be easily synthesized by the methods described in JP-A-Nos. 53-20921, 63-20922, 53-66732, 52-20318 and *Research Disclosure,* No. 23510, pages 346–352 (September, 1983).

The compound shown by formula (II), which is the dye moiety of the compound shown by formula (I) for use in this invention can be synthesized based on the descriptions of F. M. Hamer, *Heterocyclic Compounds—Cyanine Dyes and Related Compounds,* Chapter 6, pages 642–645, published by John Wiley & Sons, 1964.

Also, the compound represented by formula (III) can be synthesized based on the descriptions of the abovedescribed literature, Chapter 4–6, pages 86–199.

Then, synthesis examples of the compounds shown by formula (I) are described below on typical compounds of them.

Synthesis Example 1 Synthesis of 1-butyl-3-ethoxycarbonylmethylurea:

In a 500 ml three-neck flask equipped with a stirrer, a thermometer, a dropping funnel, and an air condenser were placed 34.5 g (0.25 mol) of hydrochloric acid glycine ethyl ester and 250 ml of acetonitrile and the mixture in the flask was stirred in an ice-cooled salt bath. Then, 40 ml of triethylamine was added thereto and when the inside temperature thereof lowered to 0° C., 25 g (0.252 mol) of n-butyl isocyanate was added dropwise to the mixture at a temperature of not higher than 5° C. Thereafter, the resultant mixture was further stirred for 2 hours. Salts deposited were filtered away and the reaction mixture obtained was concentrated at reduced pressure in a warm water bath of a temperature of not higher than 45° C. Then, 200 ml of water was added to the residue thus formed and the product was extracted with 200 ml of chloroform. The extract was separated and dried by the addition of magnesium sulfate. The extract was filtered to remove magnesium sulfate and the solvent was distilled off from the extract at a reduced pressure to provide 59 g of the white waxy desired urea derivative (I) at a stoichimetric yield.

Synthesis Example 2 Synthesis of 1-butyl-3-ethoxycarbonylmethylbarbituric acid:

In a one-liter three-neck flask equipped with a stirrer, a thermometer, a dropping funnel, and a condenser were placed 70.9 g (0.25 mol) of the urea derivative (I) obtained in Synthesis 1 and 300 ml of acetonitrile and the mixture was stirred in an ice-cooled salt bath. When the inside temperature lowered to 0° C., 35.3 g (0.25 mol) of malonic acid dichloride was gradually added dropwise to the mixture of at a temperature of not higher than 5° C. Thereafter, the mixture was further stirred for 2 hours. Then, the inside temperature was allowed to raise to room temperature and the mixture was further stirred under heating to 50° C. in inside temperature for 30 minutes. Then, the reaction mixture obtained was added to 1.2 liters of ice-water and extracted with 500 ml of chloroform. The extract was separated and dried with the addition of magnesium sulfate. Then, the extract was filtered to remove magnesium sulfate and the solvent was distilled off from the extract under reduced pressure to provide 63.9 g of the brown oily desired barbituric acid derivative (II) at a yield of 94%.

Synthesis Example 3 Synthesis of 1-butyl-3-carboxymethylbarbituric acid:

In a 500 ml three-neck flask equipped with a thermometer and a reflux condenser were placed 63.9 g of the barbituric acid derivative (II) obtained above and 100 ml of concentrated hydrochloric acid and the mixture was stirred at 60° C. in inside temperature in an oil bath for 30 minutes. Then, the temperature of the oil bath was raised and the mixture was refluxed with stirring. Then, 20 ml of concentrated hydrochloric acid was further added over a period of 2 hours and 30 minutes and thereafter, the mixture was refluxed with stirring for 3 hours. After allowing to cool the reaction mixture, 200 ml of water was added to the reaction mixture and then the produce was extracted with 200 ml of chloroform. The extracted was separated, washed once with water, and dried by the addition of magnesium sulfate. The extract was filtered to remove magnesium sulfate and the solvent was distilled off under reduced pressure to provide 42.7 g of the brown oily desired ester hydrolyzed product (III) of the barbituric acid derivative (II) with a yield of 74.5%.

Synthesis Example 4 Synthesis of 1-butyl-3-carboxymethyl-5-[1-(3-ethyl-2-(3H)-naphtho[1,2-d]thiazolinidene)propyl-2-iridene]barbituric acid:

In a one-liter three-neck flask equipped with a stirrer, a thermometer, a dropping funnel, and a reflux condenser were placed 25.4 g (0.10 mol) of the aforesaid product (III), 35.9 g (0.09 mol) of 3-ethyl-2-methyl-β-naphthothiazolium tosylate, 27.3 g (0.18 mol) of o-acetic acid ethyl ester, and 360 ml of pyridine and the mixture was stirred on a warm-water bath. After adjusting the inside temperature thereof to from 50° to 55° C., 45 ml of triethylamine was added dropwise to the mixture. The resulting mixture was further stirred by heating at the aforesaid temperature for 2 hours and thereafter, the reaction mixture thus obtained was added to 4 liters of ice-water. Then, 45 ml of concentrated hydrochloric acid was gradually added to the mixture with stirring well and the pH of the system was adjusted to 3 to 4. The resulting mixture was further stirred for one hour at room temperature, during which the dye formed was almost crystallized. The crystals of the dye were recovered by filtration and washed with water.

The coarse crystals thus obtained were dissolved in a mixture of 400 ml of acetonitrile, 90 ml of water, and 22.5 ml of triethylamine and 22.5 ml of concentrated hydrochloric acid was added to the solution to perform acid separation, whereby the product was purified to provide 27.1 g of the orange-red crystals of dimethinemerocyanine (IV) having a melting point of from 233° C. to 234° C. and λmax (MeOH) of 490 nm.

Synthesis Example 5 Synthesis of 1-butyl-5-[1-(3-ethyl-2-(2H)-naphtho[1,2-d]thiazolinidene)propyl-2iridene]-3-{N-[4-(2-formylhydrazino)phenyl]carbamidomethyl}barbituric acid:

In a 100 ml three-neck flask equipped with a stirrer and an air condenser having a calcium chloride tube at the top thereof were place 5.7 g (0.0116 mol) of the dimethinemerocyanine (IV) obtained in the above procedure, 1.92 g (0.0128 mol) of 1-formyl-2-(4-aminophenyl)-hydrazine and 200 ml of pyridine. After further adding thereto 3.8 g (0.0174 mol) of (N,N'-dicyclohexylcarbodiimide, the resulting mixture was stirred for 48 hours at room temperature. Then, 20 ml of acetonitrile was added to the content to disperse the product in it and coarse crystals formed were recovered by filtration. The coarse crystals were recrystallized twice from a mixture of methanol and chloroform to provide 780 mg of the orange-red crystals of a dimethinemerocyanine-combined product (V) having a melting point of from 233° C. to 234° C. and λmax (MeOH) of 490 nm at a yield of 11%.

Synthesis Example 6 Synthesis of 1-butyl-5-{[(3-ethyl-2(3H)-naphtho[1,2-d]thiazolinidene)methyl]-[(3-methyl-2(3H)-naphtho[1,2-d]thiazolinidene)methyl]methylidene}-3-{N-[4-(2-formylhydrazino)phenyl]carbamidomethyl}barbituric acid (Compound I-1):

In a 100 ml three-neck flask equipped with a stirrer, a thermometer, and a reflux condenser were placed 820 mg (1.31 mmol) of the aforesaid product (V), 500 mg (1.31 mmol) of 3-methyl-2-methylthio-β-naphthothiazolium tosylate and 30 ml of dimethylacetamide and the mixture was stirred on a warm-water bath. After adjusting the inside temperature to from 70° C. to 75° C., 0.6 ml of triethylamine was added thereto and the mixture was stirred by heating for 2 hours. The reaction mixture obtained was added to 250 ml of ethyl acetate to deposit crystals, which were recovered by filtration and then recrystallized twice from a mixture of methanol and chloroform to provide 410 mg of the dark green crystals of the desired compound having a melting point of from 253° C. to 256° C. and λmax of 598 nm at a yield of 38%.

The compounds shown by formula (I) and the compound shown by formula (III) may be directly dispersed in a silver halide emulsion or may be added to a silver halide emulsion as a solution in a solvent such as water, methanol, ethanol, propanol, methylcellosolve, 2,2,3,3-tetrafluoropropanol, N,N-dimethylformamide, etc., singly or as a mixture thereof. Also, they may be added to the emulsion as an aqueous solution thereof in the coexistence of an acid or a base as described in JP-B-Nos. 44-23389, 44-27555, 57-22089, etc. (the term "JP-B" as used herein means an "examined published Japanese patent application") or may be added to the emulsion as an aqueous solution or a colloid dispersion thereof in the co-existence of a surface active agent as described in U.S. Pat. Nos. 3,822,135 and 4,006,025, etc. Also, they may be dissolved in a solvent which is substantially immiscible with water, such as phenoxyethanol, etc., and added to the emulsion as a dispersion of the solution in water or an aqueous hydrophilic colloid solution. Furthermore, they may be directly dispersed in an aqueous hydrophilic colloid solution and added to the emulsion as the dispersion as described in JP-A-Nos. 53-102733, 58-105141, etc.

The sensitizing dyes for use in this invention may be dissolved in a solvent using a ultrasonic vibration described in U.S. Pat. No. 3,485,634.

As other method of adding the sensitizing dyes for use in this invention as a solution or a dispersion thereof, the methods described in U.S. Pat. Nos. 3,482,981, 3,585,195, 3,469,987, 3,425,835 and 3,342,605, British Pat. Nos. 1,271,329, 1,038,029 and 1,121,174, U.S. Pat. Nos. 3,660,101 and 3,658,546 can be also used in this invention.

Now, the sensitizing dyes for use in this invention can be added to a silver halide photographic emulsion of this invention in any step during the production of the photographic emulsion or may be added thereto in any step after the production of the emulsion and directly before coating thereof. As an example of the former case, there are a step of forming silver halide grains, a step of physical-ripening silver halide grains, a step of chemical-ripening silver halide grains, etc. For example, the sensitizing dyes may be added to the silver halide emulsion during the formation of the silver halide grains as described in JP-A-No. 55-26589.

The amount of each of the sensitizing dye shown by formula (I) and the sensitizing dye shown by formula (III) for use in the silver halide photographic emulsion of this invention is from $5\times10^{-7}$ mol to $5\times10^{-3}$ mol per mol of the silver halide in the same halide emulsion layer, with preferably from $5\times10^{-6}$ mol to $5\times10^{-3}$ mol, and particularly preferably from $1\times10^{-5}$ mol to $5\times10^{-3}$ mol per mol of the silver halide for the sensitizing dye shown by formula (III) and preferably from $1\times10^{-6}$ mol to $5\times10^{-4}$ mol, and particularly preferably from $1\times10^{-6}$ mol to $6\times10^{-5}$ mol per mol of the silver halide for the sensitizing dye shown by formula (I).

Furthermore, in the case of using the compound (sensitizing dye) shown by formula (I) and the compound (sensitizing dye) shown by formula (III) together in a silver halide photographic emulsion, the proportion of the compound of formula (I) to the compound of formula (III) is preferably not more than an equimolar amount to the amount of the latter compound, more preferably from ½ mol to 1/150 mol, and particularly preferably from ⅓ mol to 1/50 mol of the latter compound.

As the silver halide for the silver halide photographic emulsion of this invention, any silver halide such as silver bromide, silver iodobromide, silver iodochlorobromide, silver chlorobromide, or silver chloride can be used.

The silver halide grains for the silver halide photographic emulsion of this invention may have any appearance of crystals.

The silver halide grains for the silver halide photographic emulsion of this invention may be tabular silver halide grains having a thickness of not more than 0.5 μm, and preferably not more than 0.3 μm and a diameter of at least 0.6 μm, wherein silver halide grains having a mean aspect ratio of at least 5 account for at least 50% of the total projected area thereof. Also, the silver halide emulsion of this invention may be mono-dispersed emulsion of silver halide grains wherein the silver halide grains having grain sizes of within ±40% of the mean grain size account for at least 95% thereof by grain number.

The silver halide grains may have different phase between the inside thereof and the surface layer thereof or may be composed of a unform phase throughout the whole grain. Also, the silver halide grains may be the grains of forming latent images mainly on the surface thereof (e.g., a negative working silver halide emulsion) or the grains of forming latent images mainly in the inside thereof (e.g., an inside latent images type emulsion and a previously fogged direct reversal type emulsion).

The silver halide photographic emulsions of this invention can be prepared according to the methods described in P.Glafkides, *Chimie et Physique Photographique,* published by Paul Montel, 1967; G. F. Duffin, *Photographic Emulsion Chemistry,* published by Focal Press, 1966; and V. L. Zelikman et al, *Making and Coating Photographic Emulsion,* published by Focal Press, 1964, etc.

That is, the emulsion can be prepared by an acid method, a neutralization method, an ammonia method, etc., and as a method of reacting a soluble silver salt and a soluble halide, a single jet method, a double jet method, or a combination thereof may be employed.

A so-called reverse mixing method of forming silver halide grains in the existence of excess silver ions can be also used. As one system of the double jet method, a so-called controlled double jet method of keeping a constant pAg in a liquid phase of forming silver halide grains can be also used. According to the method, a silver halide emulsion containing silver halide grains having a regular crystal form and substantially uniform grain sizes can be obtained.

A mixture of two or more kinds of silver halide emulsions each formed separately.

Also, at the formation of silver halide grains, ammonia, potassium rhodanate, ammonium rhodanate, thioether compounds (as described, e.g., in U.S. Pat. Nos. 3,271,157, 3,574,628, 3,704,130, 4,297,439 and 4,276,374), thione compounds (as described, e.g., in JP-A-Nos. 53-144319, 53-82408 and 55-77737), or amine compounds (as described, e.g., in JP-A-No. 54-100717) can be used as a silver halide solvent for controlling the growth of the grains.

During the formation or physical ripening of the silver halide grains, a cadmium salt, a zinc salt, a thallium salt, an iridium salt or a complex salt thereof, a rhodium salt or a complex salt thereof, an iron salt or a complex salt thereof, etc., may exist in the system.

Also, as the inside latent image type silver halide emulsion of this invention, there are silver halide emulsions containing a different metal described in U.S. Pat. Nos. 2,592,250, 3,206,313, 3,447,927, 3,761,276 and 3,935,014.

The silver halide emulsion is usually chemically sensitized. For the chemical sensitization, the methods described in H. Frieser, *Die Grundlaqen der Photographischen Prozesse mit Silber-haloqeniden,* pages 675–734, published by Akademische Verlagsgesellschaft, 1968 can be used.

That is, a sulfur sensitization method using an active gelatin or a sulfur-containing compound capable of reacting with silver (e.g., thiosulfates, thioureas, mecapto compounds, and rhodanines), a reduction sensitization method using a reducing material (e.g., stannous salts, amines, hydrazine derivatives, formamidinesulfinic acid, and silane compounds), and a noble metal sensitization method using a noble metal compound (e.g., a gold complex salt and complex salts of a metal belonging to Group VIII of the periodic table, such as Pt, Ph, Ir, Pd, etc.) can be used solely or as a combination thereof.

As practical chemical sensitizers which can be used for chemically sensitizing the silver halide emulsions of this invention, there are sulfur sensitizers such as allylthiocarbamide, thiourea, sodium thiosulfate, cystine, etc. noble metal sensitizers such as potassium chloroaurate, aurous thiosulfate, potassium chloropalladate, etc., and reduction sensitizers such as tin chloride, phenylhydrazine, reductone, etc. Other sensitizers such as polyoxyethylene compounds, polyoxypropylene compounds, compounds having a quaternary ammonium group, etc., can be also used.

The silver halide photographic emulsions of this invention can contain various kinds of compounds for inhibiting the formation of fog during the production, storage, or photographic processing of the photographic light-sensitive materials of this invention containing the photographic emulsions or for stabilizing the photographic performance thereof. That is, there are various compounds known as antifoggants or stabilizers, such as azoles, e.g., benzothiazolium salts, nitroindazoles, triazoles, benzotriazoles, and benzimidazoles (in particular, nitroor halogen-substituted products thereof); heterocyclic mercapto compounds, e.g., mercaptothiazoles, mercaptobenzothiazoles, mercaptobenzimidazoles, mercaptothiadiazoles, mercaptotetrazoles (in particular, 1-phenyl-5-mercaptotetrazole), and mercaptopyrimidines; the aforesaid heterocyclic mercapto compounds having a water-soluble group such as a carboxy group and a sulfo group; thioketo compounds; e.g., oxazolinethiones; azaindenes, e.g., tetrazaindene (in particular, 4-hydroxy-substituted (1,3,3a,7)tetraazaindenes; benzenethiosulfonic acids, benzenesulfinic acid, etc.

The silver halide photographic emulsions of this invention can contain polymer latexes composed of a homopolymer or copolymer of an alkyl acrylate, an alkyl methacrylate, acrylic acid, glycidyl acrylate, etc., described in U.S. Pat. Nos. 3,411,911, 3,411,912, 3,142,568, 3,325,286 and 3,547,650 and JP-B-No. 45-5331 for improving the dimensional stability of the photographic light-sensitive materials or improving the properties of layers.

In the case of using the silver halide emulsions of this invention for lithographic type photographic light-sensitive materials for making printing plates, polyalkylene oxide compounds can be used for increasing the infectious development effect. For example, the compounds described in U.S. Pat. Nos. 2,400,532 3,294,547, 3,294,537 and 3,294,540, Frenchi Pat. Nos. 1,491,805 and 1,596,537, JP-B-No. 40-23466, and JP-A-No. 50-156423, 54-18726 and 56-151933 can be used. Preferred examples of these compounds are the condensation products of polyalkylene oxide composed of at least 10 units of alkylene oxide having from 2 to 4 carbon atoms, such as ethylene oxide, propylene-1,2-oxide, butylene-1,2-oxide, etc., preferably ethylene oxide and a compound having at least one active hydrogen atom, such as water, aliphatic alcohols, aromatic alcohols, fatty acids, organic amines, hexitol derivatives, etc., and block polymers of two or more kinds of polyalkylene oxides. Specific examples of the polyalkylene oxide compound are polyalkylene glycol alkyl ethers, polyalkylene glycol aryl ethers, polyalkylene glycol alkylaryl ethers, polyalkylene glycol esters, polyalkylene glycol fatty acid amides, polyalkylene glycol amines, polyalkylene glycol block copolymers, polyalkylene glycol graft polymers, etc.

The molecular weight of the polyalkylene oxide compound which can be used for the photographic emulsions of this invention is from 300 to 15,000, and preferably from 600 to 8,000. The addition amount of the polyalkylene oxide compound is preferably from 10 mg to 3 g per mol of silver halide in the emulsion. The addition time can be optionally selected during the production of the silver halide emulsion.

The silver halide photographic emulsions of this invention can contain color couplers such as cyan couplers, magenta couplers, and yellow couplers and compounds for dispersing the couplers.

That is, the photographic emulsions can contain compounds capable of coloring by the oxidative coupling of an aromatic primary amine developing agent (e.g., phenylenediamine derivatives and aminophenol derivatives) in a color development process.

For example, as magenta couplers, there are 5-pyrazolone couplers, pyrazolobenzimidazole couplers, cyanoacetylcoumarone couplers, open clain acylacetonitrile couplers, etc.; as yellow couplers, there are acylacetamide couplers (e.g., benzoylacetanilides and pivaloylacetanilides), etc.; and as cyan couplers, there are naphthol couplers, phenol couplers, etc. These couplers are preferably non-diffusible couplers having a hydrophobic group called as ballast group in the molecule. These couplers may be 4-equivalent or 2-equivalent to a silver ion. Also, the photographic emulsions may contain colored couplers having a color correction effect or couplers releasing a development inhibitor upon color development (so-called DIR couplers).

Also, the photographic emulsions may contain non-coloring DIR coupling compounds giving a colorless coupling reaction product and releasing a development inhibitor in place of the DIR couplers.

The silver halide photographic emulsions of this invention may further contain water-soluble dyes (e.g., oxonol dyes, hemioxonol dyes, and merocyanine dyes) as filter dyes or various purposes such as irradiation prevention, etc.

The silver halide photographic emulsions of this invention may further contain various surface active agents for coating aid, static prevention, the improvement of slidability, the improvement of dispersibility by emulsification, sticking prevention, and the improvement of photographic characteristics (e.g., development acceleration, the increase of contract or sensitivity, etc.).

Examples of the surface active agents are nonionic surface active agents such as saponin (steroid series), alkylene oxide derivatives (e.g., polyethylene glycol), polyethylene glycol alkyl ethers, glycidol derivatives, fatty acid esters of polyhydric alcohols, alkyl esters of saccharides, etc.; anionic surface active agents such as alkylcarboxylates, alkylsulfonates, alkylbenzenesulfonates, alkylsulfuric acid esters, etc.; and cationic surface active agents such as alkylamine salts, aliphatic or aromatic quaternary ammonium salts, heterocyclic quaternary ammonium salts such as pyridiniums, imidazoliums, etc. Also, when the surface active agents are used for static prevention, fluorine-containing surface active agents are preferably used.

For the silver halide emulsions of this invention, the following fading inhibitors can be used and also dye image stabilizers can be used singly or as a combination thereof. As fading inhibitors, there are hydroquinone derivatives, gallic acid derivatives, p-alkoxyphenols, hindered phenol derivatives, and bisphenol derivatives.

The photographic emulsions of this invention may contain inorganic or organic hardening agents. Examples of the hardening agent are chromium salts (e.g., chromium alum, chromium acetate), aldehydes (e.g., formaldehyde, glyoxal, glutal aldehyde), active vinyl compounds (e.g., 1,3,5-triacryloyl-hexahydro-s-triazine, 1,3-vinylsulfonyl-2-porpanol), and active halogen compounds (e.g., 2,4-dichloro-6-hydroxy-s-triazine) and they can be used singly or as a combination thereof.

The silver halide photographic emulsions of this invention may further contain hydroquinone derivatives, aminophenol derivatives, gallic acid derivatives as color fog inhibitors.

Also, the photographic emulsions of this invention can contain acylated gelatin (e.g., phthalated gelatin, malonated gelatin), cellulose compounds (e.g., hydroxyethyl cellulose, carboxymethyl cellulose), soluble starch (e.g, dextrin), and hydrophilic polymers (e.g., polyvinyl alcohol, polyvinylpyrrolidone, polyacrylamide, polystyrenesulfonic acid) other than gelatin as a protective colloid; plasticizers and latex polymers as a dimensional stabilizer; and matting agents.

The finished silver halide emulsion of this invention is coated on a proper support such as barytacoated papers, resin-coated papers, synthetic papers, triacetate films, polyethylene terephthalate films, and other plastic film bases or glass sheets.

The light exposure for obtaining photographic images using the photographic emulsions of this invention can be performed by an ordinary method. That is, various light sources such as natural light (sun light), a tungsten lamp, a fluorescent lamp, a mercury lamp, a xenon arc lamp, a carbon arc lamp, a xenon flash lamp, laser, LED and CRT.

The exposure time is usually from 1/1,000 second to 1 second, which is used for ordinary camera but may be shorter than 1/1,000 second as in the case of using, for example, a xenon flash lamp (using the exposure time of $1/10^4$ to $1/10^6$) or may be longer than 1 second. If necessary, the spectral composition of light being used for the light exposure can be controlled using color filters. Laser light can be used for the light exposure or light emitted from a fluorescent substance excited by electron beams, X rays, γ-rays, α-rays, etc., may be used.

The spectral sensitizing dyes for use in this invention described hereinabove are used for the sensitization of silver halide photographic emulsions for various color and black and white light-sensitive materials. Examples of the photographic emulsions are emulsions for color positive light-sensitive materials, emulsions for color photographic papers, emulsions for color negative photographic films, emulsions for color reversal light-sensitive materials (including or not including couplers), emulsions for photographic light-sensitive materials for making printing plates (e.g., lithographic films), emulsions for cathode ray display light-sensitive materials, emulsions for color diffusion transfer process, emulsions for imbitio transfer process (described in U.S. Pat. No. 2,882,156), emulsions for silver dye bleach process, emulsions for light-sensitive materials for recording printout images described in U.S. Pat. No. 2,369,449, etc.), emulsions for direct print image light-sensitive materials (described in U.S. Pat. No. 3,033,682, etc.), and emulsions for heat-developable color photographic light-sensitive materials.

For photographic light-sensitive materials using the silver halide emulsions of this invention, known processes and known processing liquids as described in *Research Disclosure,* No. 176 (RD-17643), pages 28–30 can be applied. The photographic process may be, according to the purposes, a photographic process of forming silver images (black and white photographic process) or a photographic process of forming dye images (color photographic process). The processing temperature is usually selected from 18° C. to 50° C. but it may be lower than 18° C. or over 50° C. as the case may be.

Then, the invention is more practically described in the following examples but the invention is not limited to them.

EXAMPLE 1

In a reaction vessel were placed 1,000 ml of water, 25 g of de-ionized bone gelatin, 15 ml of an aqueous solution of 50% $NH_4SO_3$, and 7.5 ml of an aqueous solution of 25% $NH_3$, the mixture was stirred well at 50° C., 750 ml of an aqueous solution of 1N $AgNO_3$ and an aqueous solution of 1N KBr were added thereto over a period of 50 minutes, and the silver potential during the reaction was kept at +50 mV to a saturated calomel electrode.

The silver bromide grains obtained were cubic grains having a long side length of 0.78±0.06 μm.

The emulsion thus obtained was de-salted, 95 g of de-ionized bone gelatin and 430 ml of water were added thereto, and after adjusting the pH and pAg thereof to 6.5 and 8.3, respectively at 50° C., the emulsion was ripened by adding sodium thiosulfate at 55° C. for 50 minutes so that the emulsion was imparted with the optimum sensitivity. The silver halide emulsion obtained contained 0.74 mol of silver bromide per kg of the emulsion.

The silver halide emulsion formed was sampled in 50 g each and after adding to each sample the sensitizing dyes as shown in Table 1 below, 10 mg of 4-hydroxy-6-methyl-1,3,3a,7-tetraazaindene, 15 g of a gel of 10% de-ionized gelatin, and 55 ml of water, the emulsion was coated on a polyethylene terephthalate base as shown below.

For comparison, a test sample was also prepared by the same manner as above using Comparison sensitizing dyes (RS-1), (RS-2) and (RS-3) shown below.

The coating amount of the emulsion was 2.5 g/m$^2$ for silver and 3.8 g/m$^2$ for gelatin and also an aqueous solution containing 0.22 g/liter of sodium dodecylbenzenesulfonate, 0.50 g/liter of p-sulfostyrene sodium homopolymer, 3.1 g/liter of 2,4-dichloro-6-hydroxy-1,3,5-triazine sodium, and 50 g/liter of gelatin as the main components was simultaneously coated as the upper layer.

Each sample was exposed for 1 second to tungsten light (2,854° K.) through a continuous wedge using a blue filter (band pass filter of transmitting light having wavelengths of from 395 nm to 440 nm) and a red filter (filter transmitting light of wavelengths longer than 600 nm).

After exposure, the sample was developed using a developer having the composition shown below for 2 minutes.

| (Composition of Developer) | |
|---|---|
| Water | 700 ml |
| Metol | 3.1 g |
| Sodium Sulfite (anhydrous) | 45 g |
| Hydroquinone | 12 g |
| Sodium Carbonate (mono-hydrate) | 79 g |
| Potassium Bromide | 1.9 g |
| Water to make | 1 liter |

At use, the aforesaid composition was diluted with water of twice the volume of the composition.

Then, the sensitivity of each sample thus developed was measured using a densitometer made by Fuji Photo Film Co., Ltd. to give the red filter sensitivity (SR), the blue filter sensitivity (SB) and fog. The standard point of the optical density for determining the sensitivity was a point of (fog+0.2). In addition, SR and SB were shown by the relative sensitivities to 100 (standard).

The results obtained ar shown in Table 1 as relative values.

TABLE 1

| Test No. | Sensitizing Dye and Amount of it | | SR | SB | Fog | Note |
|---|---|---|---|---|---|---|
| I-1 | — | | — | 100 (standard) | 0.03 | |
| I-2 | (RS-1) | 0.38 | 68 | 69 | 0.03 | Comparison |
| I-3 | " | 0.75 | 100 (standard) | 53 | 0.03 | " |
| I-4 | " | 1.50 | 45 | 59 | 0.03 | " |
| I-5 | (RS-2) | 0.75 | 794 | 28 | 0.03 | Comparison |
| I-6 | " | 1.50 | 1,000 | 14 | 0.03 | " |
| I-7 | " | 3.00 | 741 | 6 | 0.03 | " |
| I-8 | (RS-3) | 0.38 | 41 | 93 | 0.03 | Comparison |
| I-9 | " | 0.75 | 49 | 89 | 0.04 | " |

TABLE 1-continued

| Test No. | Sensitizing Dye and Amount of it | | SR | SB | Fog | Note |
|---|---|---|---|---|---|---|
| I-10 | " | 1.50 | 29 | 93 | 0.04 | " |
| I-11 | (I-1) | 0.75 | 3,236 | 40 | 0.03 | Invention |
| I-12 | " | 1.50 | 3,548 | 40 | 0.04 | " |
| I-13 | " | 3.00 | 3,236 | 31 | 0.05 | " |
| I-14 | (I-9) | 0.75 | 2,884 | 36 | 0.03 | Invention |
| I-15 | " | 1.50 | 2,120 | 35 | 0.04 | " |
| I-16 | " | 3.00 | 2,188 | 30 | 0.05 | " |
| I-17 | (I-12) | 0.75 | 1,698 | 72 | 0.03 | Invention |
| I-18 | " | 1.50 | 2,455 | 68 | 0.03 | " |
| I-19 | " | 3.00 | 2,042 | 51 | 0.04 | " |

The comparison sensitizing dyes used for the comparison sample are shown below.

(RS-1)

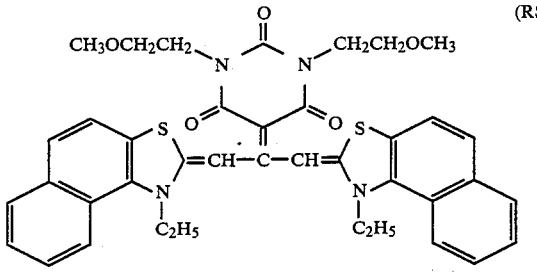

(RS-2)

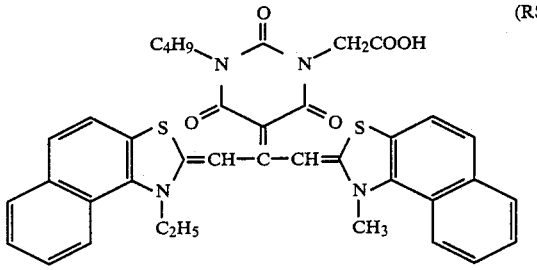

(RS-3)

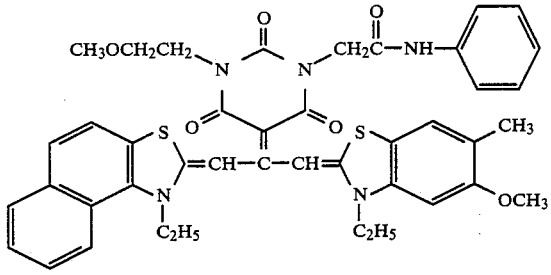

As is clear from the results shown in Table 1, it can be seen that the novel holopolar dyes for use in this invention show a high red sensitivity. The comparison compounds shown above are the compounds included in those described in JP No. A-59-148053, U.S. Pat. Nos. 4,326,023, and 2,739,964, respectively and the sensitizing dyes for use in this invention give very high spectral sensitivity as compared to these comparison dyes.

EXAMPLE 2

The silver halide emulsion used in the example was prepared as follows.

| | |
|---|---|
| Liquid 1: | |
| Water | 1,000 ml |
| Sodium Chloride | 5.5 g |
| Gelatin | 32 g |
| Liquid 2: | |
| Sulfuric Acid (1 N) | 24 ml |
| Liquid 3: | |
| Silver Halide Solvent (1%) shown below | 3 ml |

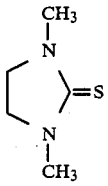

| | |
|---|---|
| Liquid 4: | |
| Potassium Bromide | 15.66 g |
| Sodium Chloride | 3.30 g |
| Water to make | 200 ml |
| Liquid 5: | |
| Silver Nitrate | 32 g |
| Water to make | 200 ml |
| Liquid 6: | |
| Potassium Bromide | 62.72 g |
| Sodium Chloride | 13.22 g |
| $K_2IrCl_6$ (0.001%) | 4.54 ml |
| Water to make | 600 ml |
| Liquid 7: | |
| Silver Nitrate | 128 g |
| Water to make | 600 ml |

Liquid 1 was heated to 55° C. and Liquid 2 and Liquid 3 were added thereto and thereafter, Liquid 4 and Liquid 5 were simultaneously added thereto over a period of 30 minutes. Furthermore, after 10 minutes since then, Liquid 6 and Liquid 7 were simultaneously added to the mixture over a period of 20 minutes. After 5 minute since the addition, the temperature of the mixture was lowered and the resulting mixture was desalted. Then, water and dispersed gelatin were added thereto and the pH of the mixture was adjusted to 6.2 to provide a mono-dispersed silver chlorobromide emulsion having a mean grain size of 0.48 μm and a silver bromide content of 70 mol %. To the emulsion the optimum chemical sensitization was applied by adding thereto $1.0\times10^{-4}$ mol/mol-Ag of chloroauric acid and further sodium thiosulfate.

The emulsion was split into several parts and the sensitizing dye shown in Table 2 below was added to each part at 40° C. followed by stirring for 15 minutes.

Then, 3.0 g of sodium dodecylbenzenesulfonate, 4.0 g of a sodium p-sulfocinnamate homopolymer, and 1.0 g of 4-hydroxy-6-methyl-1,3,3a,7-tetraazaindene per mol of silver halide were added to each sampled emulsion and after further adding thereto an emulsion of the coupler shown in Table 2 below followed by stirring, the emulsion was coated on a paper support both surfaces of which were coated with polyethylene as follows.

The coating amount was adjusted to 0.35 g/m$^2$ for silver and 1.5 g/m$^2$ for gelatin and an aqueous gelatin solution containing 1.5 g/m2 of gelatin, 0.010 g/m$^2$ of sodium 1,2-bis(2-ethylhexyloxycarbonyl)ethanesulfonate, 0.020 g/m$^2$ of sodium dodecylbenzenesulfonate, 0.011 g/m$^2$ of sodium p-sulfocinnamate homopolymer, and 0.060 g/m$^2$ of 2,4-dichloro-6-hydroxy-1,3,5-triazien sodium as the main components was simultaneously coated as an upper layer to provide each coated sample.

Each sample was exposed to a tungsten lamp (3,200° K.) for 0.5 second using the red filter as used in Example 1 and then processed in the following processing steps.

| Processing | Temperature | Time |
|---|---|---|
| Color Development | 33° C. | 3 min. 30 sec. |
| Blix | 33° C. | 1 min. 30 sec. |
| Rinse | 28° C. to 35° C. | 1 min. 30 sec. |

The compositions of the processing liquids were as follows.

| | |
|---|---|
| (Color Developer) | |
| Water | 800 ml |
| Diethylenetriaminepentaacetic Acid. | 2.0 g |
| Benzyl Alcohol | 15 ml |
| Diethylene Glycol | 10 ml |
| Sodium Sulfite | 2.0 g |
| Potassium Bromide | 1.0 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| Sodium Carbonate (mono-hydrate) | 30.0 g |
| Fluorescent Whitening Agent (stilbene series) | 1.0 g |
| Water to make | 1,000 ml (pH 10.2) |
| (Blix Solution) | |
| Ammonium Thiosulfate (54 wt. %) | 150 ml |
| Sodium Sulfite | 15 g |
| $NH_4$[Fe(III) (EDTA)] | 55 g |
| EDTA.2Na | 4 g |
| Glacial Acetic Acid | 8.61 g |
| Water to make | 1,000 ml (pH 5.4) |
| EDTA: Ethylenediaminetetraacetic acid | |
| (Rinse Solution) | |
| EDTA.2Na.2$H_2O$ | 0.4 g |
| Water to make | 1,000 ml (pH 7.0) |

The results are shown in Table 2. The evaluation of the photographic property was performed by a relative sensitivity among the samples containing a same coupler, wherein the sensitivity of the sample containing the comparison sensitizing dye (RS-1) was shown as 100 (standard). The standard point of the optical density of determining the sensitivity was a point of (fog+0.5).

TABLE 2

| Test No. | Sensitizing Dye and Amount of it × $10^{-4}$ mol/mol-Ag | | Coupler and Amount g/mol-Ag | | Relative Sensitivity | Note |
|---|---|---|---|---|---|---|
| 3-1 | (RS-1) | 0.75 | (C-1) | 21.6 | 100 (standard) | Comparison |
| 3-2 | " | 1.50 | " | 21.6 | 58 | " |
| 3-3 | " | 3.00 | " | 21.6 | 43 | " |
| 3-4 | (I-1) | 0.75 | (C-1) | 21.6 | 2,630 | Invention |
| 3-5 | " | 1.50 | " | 21.6 | 3,120 | " |
| 3-6 | " | 3.00 | " | 21.6 | 2,455 | " |
| 3-7 | (RS-1) | 0.75 | (C-2) | 21.6 | 100 (standard) | Comparison |
| 3-8 | " | 1.50 | " | 21.6 | 59 | " |
| 3-9 | " | 3.00 | " | 21.6 | 45 | " |
| 3-10 | (I-9) | 0.75 | (C-2) | 21.6 | 2,344 | Invention |
| 3-11 | " | 1.50 | " | 21.6 | 2,630 | " |
| 3-12 | " | 3.00 | " | 21.6 | 1,905 | " |
| 3-13 | (I-9) | 0.75 | (C-3) | 50.4 | 100 | Comparison |
| 3-14 | " | 1.50 | " | 50.4 | 120 | " |
| 3-15 | " | 3.00 | " | 50.4 | 94 | " |
| 3-16 | (I-1) | 0.75 | (C-3) | 50.4 | 355 | Invention |
| 3-17 | " | 1.50 | " | 50.4 | 407 | " |
| 3-18 | " | 3.00 | " | 50.4 | 331 | " |

The chemical structures of the couplers used in the example were as follows.

Penta-sodium

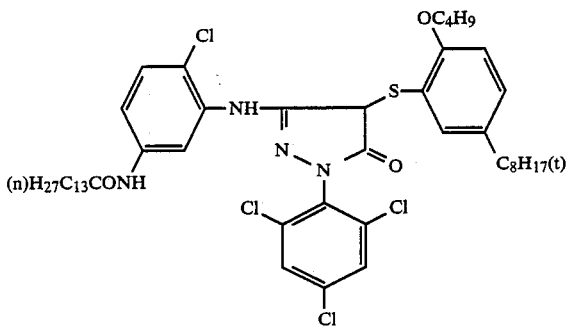

(C-1)

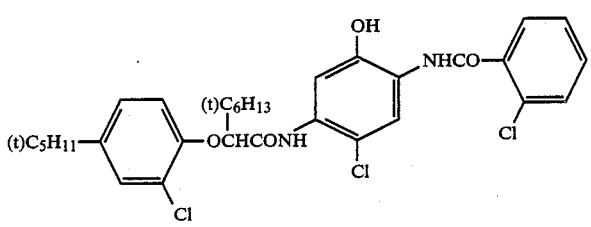

(C-2)

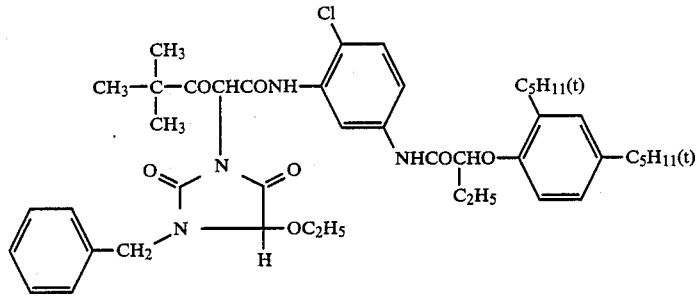

(C-3)

From the results shown in Table 2, it can be seen that when the silver halide emulsion having a different composition than that in Example 1 and a color development were used, the use of the sensitizing dye for use in this invention gives a high spectral sensitivity as in Example 1.

EXAMPLE 3

A silver bromide emulsion was prepared by following the same procedure as in Example 1, 50 g each of the emulsion was samples, the sensitizing dye(s) were added to each sampled emulsion as shown in Table 3, and after adding thereto 10 mg of 4-hydroxy-6-methyl-1,3,3a,7-tetraazaindene,15 g of a gel of 10% de-ionized gelatin, and 55 ml of water, the emulsion was coated on a polyethylene terephthalate film base as follows. In addition, for comparison, comparison samples were also prepared using a comparison sensitizing dye (RS-4) shown below in place of the sensitizing dye of formula (I) for use in this invention.

The coating amount was adjusted to give 2.5 g/m$^2$ for silver and 3.8 g/m$^2$ for gelatin and an aqueous gelatin solution containing 0.22 g/liter of sodium dodecylbenzenesulfonate, 0.50 g/liter of p-sulfostyrene sodium homopolymer, 3.1 g/liter of 2,4-dichloro-6-hydroxy-1,3,5-triazine sodium, and 50 g/liter of gelatin as the main components was simultaneously coated at a gelatin coverage of 1.0 g/m$^2$ as an upper layer.

Each sample was exposed to a tungsten lamp (2,854° K.) for one second through a continuous wedge using a blue filter (band pass filter transmitting light of wavelengths of from 395 nm to 440 nm) and a red filter (a filter transmitting light of wavelengths of longer than 600 nm).

After exposure, each sample was developed by the developer having the same composition as in Example 1 for 2 minutes at 20° C. the density of the sample film thus developed was measured using a densitometer made by Fuji Photo Film Co., Ltd. to obtain a red filter sensitivity (SR), a blue filter sensitivity (SB), and fog. The standard point of the optical density for determining the sensitivity was a point of (fog+0.2). In addition, SR and SB were shown by relative sensitivities to 100 (standard).

The results obtained are shown in Table 3 below as relative values.

The comparison sensitizing dye used for the comparison sample is as follows.

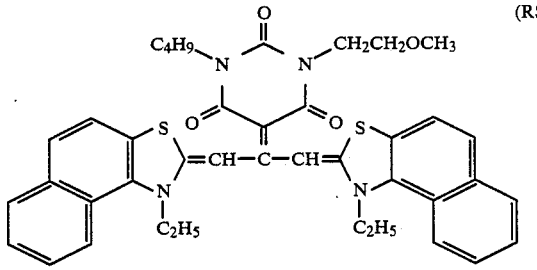

(RS-4)

TABLE 3

| Test No. | Sensitizing Dye and Amount × $10^{-4}$ mol/mol-Ag | | Sensitizing Dye and Amount × $10^{-4}$ mol/mol-Ag | | SR | SB | Fog | Note |
|---|---|---|---|---|---|---|---|---|
| 1 | — | | — | | — | 100 (standard) | 0.03 | |
| 2 | (III-9) | 0.75 | — | | 100 (standard) | 85 | 0.04 | Comparison |
| 3 | " | 1.50 | — | | 132 | 68 | 0.04 | Comparison |
| 4 | " | 3.00 | — | | 123 | 43 | 0.04 | Comparison |
| 5 | — | | (RS-4) | 3.8 | 2.5 | 69 | 0.03 | Comparison |
| 6 | — | | " | 7.5 | 3.6 | 53 | 0.03 | Comparison |
| 7 | — | | " | 15.0 | 1.6 | 59 | 0.03 | Comparison |
| 8 | — | | (I-1) | 3.8 | 95 | 45 | 0.03 | |
| 9 | — | | " | 7.5 | 117 | 40 | 0.03 | |
| 10 | — | | " | 15.0 | 129 | 40 | 0.04 | |
| 11 | — | | (I-2) | 2.5 | 78 | 44 | 0.03 | |
| 12 | — | | " | 5.0 | 105 | 32 | 0.03 | |
| 13 | — | | " | 10.0 | 105 | 38 | 0.03 | |
| 14 | (III-9) | 1.50 | (RS-4) | 1.5 | 213 | 35 | 0.04 | Comparison |
| 15 | " | 1.50 | " | 4.5 | 219 | 30 | 0.04 | Comparison |
| 16 | " | 3.00 | " | 15.0 | 195 | 35 | 0.05 | Comparison |
| 17 | (III-9) | 1.5 | (I-1) | 2.2 | 417 | 49 | 0.04 | Invention |
| 18 | " | 1.5 | " | 6.6 | 427 | 44 | 0.04 | Invention |
| 19 | " | 1.5 | " | 13.2 | 389 | 35 | 0.05 | Invention |
| 20 | (III-9) | 1.5 | (I-2) | 1.5 | 347 | 48 | 0.04 | Invention |
| 21 | " | 1.5 | " | 5.0 | 355 | 41 | 0.04 | Invention |
| 22 | " | 1.5 | " | 15.0 | 257 | 30 | 0.04 | Invention |
| 23 | (III-2) | 0.75 | — | | 132 | 82 | 0.03 | Comparison |
| 24 | " | 1.5 | — | | 195 | 68 | 0.03 | Comparison |
| 25 | " | 3.0 | — | | 178 | 48 | 0.04 | Comparison |
| 26 | (III-2) | 1.5 | (RS-4) | 1.5 | 219 | 43 | 0.03 | Comparison |
| 27 | " | 1.5 | " | 4.5 | 240 | 41 | 0.04 | Comparison |
| 28 | " | 1.5 | " | 9.0 | 234 | 38 | 0.04 | Comparison |
| 29 | (III-2) | 1.5 | (I-1) | 1.5 | 417 | 55 | 0.03 | Invention |
| 31 | " | 1.5 | " | 4.5 | 468 | 51 | 0.03 | Invention |
| 32 | " | 1.5 | " | 9.0 | 437 | 47 | 0.04 | Invention |

As is clear from the results of Table 3, it can be seen that the combination of the sensitizing dyes for use in this invention provides a higher red sensitivity. The comparison compounds are included in the compounds described in U.S. Pat. Nos. 4,326,023 and 4,546,074, respectively and are said to give an excellent super-sensitization when the compounds used together with the sensitizing dye III-9 or a homolog thereof. As shown by the results of Test Nos. 14 to 16, a high red sensitivity is obtained for the silver halide emulsion. However, the combination of the sensitizing dyes in this invention give far higher red sensitivity as compared with the aforesaid known combinations.

EXAMPLES 4

While keeping 1,000 ml of an aqueous 3% gelatin solution containing 17 mg of 3,4-dimethyl-4-thiazoline-2-thione at 65° C., 750 ml of an aqueous 1N silver nitrate solution and an aqueous solution of potassium bromide and potassium iodide so that potassium bromide became 0.98 mol/liter and potassium iodide became 0.02 mol/liter at coating were simultaneously added thereto with stirring well at a constant silver potential (−90 mV to standard calomel electrode SCE) over a period of 60 minutes to form a mono-dispersed octahedral silver iodobromide emulsion (mean grain size of about 0.67 μm and a coefficient of variation of 9.3%) having a silver iodide content of 2 mol % and the emulsion was subjected to desalting by an ordinary flocculation method.

To the emulsion were added 95 g of de-ionized bone gelatin and 430 ml of water, the pH and pAg thereof were adjusted to 6.4 and 8.5, respectively at 50° C., and the emulsion was ripened with the addition of an aqueous solution of an optimum amount of $Na_3Au(S_2O_3)_3$ for 60 minutes at 50° C. to perform gold and sulfur sensitizations.

The emulsion thus obtained was coated on a polyethylene terephthalate by the same manner as in Example 3 except that the sensitizing dyes shown in Table 3 were changed to the sensitizing dyes shown in Table 4 below.

In addition, comparison samples were also prepared by the same manner as above using the sensitizing dyes (RS-5) and (RS-3) shown below as the comparison sensitizing dyes.

Each of the coated samples was exposed and developed as in Example 1 and the sensitivity of each sample was measured as in the same example.

The comparison sensitizing dyes used for the comparison samples were as follows.

(RS-5)

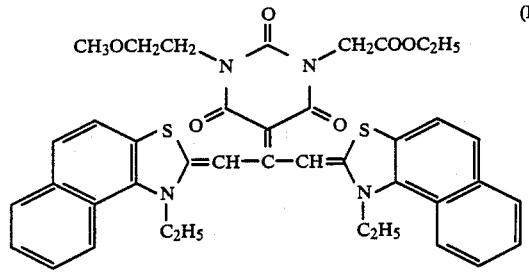

Same as used in Example 1 as the comparison sensitizing dye.

The results obtained are shown in Table 4.

TABLE 4

| Test No. | Sensitizing Dye and Amount × $10^{-4}$ mol/mol-Ag | | Sensitizing Dye and Amount × $10^{-4}$ mol/mol-Ag | | SR | SB | Fog | Note |
|---|---|---|---|---|---|---|---|---|
| 32 | — | | — | | — | 100 (standard) | 0.04 | |
| 33 | (III-1) | 3.7 | — | | 100 (standard) | 72 | 0.04 | |
| 34 | — | | (RS-5) | 0.3 | 5.8 | 110 | 0.03 | |
| 35 | — | | " | 0.6 | 6.6 | 120 | 0.03 | |
| 36 | — | | " | 1.2 | 4.4 | 126 | 0.04 | |
| 37 | — | | (RS-3) | 0.3 | 17 | 87 | 0.03 | |
| 38 | — | | " | 0.6 | 15 | 74 | 0.03 | |
| 39 | — | | " | 1.2 | 10 | 66 | 0.04 | |
| 40 | — | | (I-1) | 0.15 | 110 | 125 | 0.08 | |
| 41 | — | | " | 0.3 | 178 | 240 | 0.24 | |
| 42 | — | | (I-9) | 0.3 | 120 | 102 | 0.04 | |
| 43 | — | | " | 0.6 | 151 | 112 | 0.09 | |
| 44 | — | | " | 1.2 | 204 | 132 | 0.15 | |
| 45 | (III-1) | 3.7 | (RS-5) | 0.15 | 257 | 81 | 0.04 | Comparison |
| 46 | " | 3.7 | " | 0.3 | 275 | 81 | 0.05 | Comparison |
| 47 | " | 3.7 | " | 0.6 | 234 | 76 | 0.06 | Comparison |
| 48 | (III-1) | 3.7 | (RS-3) | 0.3 | 204 | 83 | 0.04 | Comparison |
| 49 | " | 3.7 | " | 0.6 | 230 | 74 | 0.05 | Comparison |
| 50 | " | 3.7 | " | 1.2 | 166 | 65 | 0.05 | Comparison |
| 51 | (III-1) | 3.7 | (I-1) | 0.03 | 331 | 138 | 0.04 | Invention |
| 52 | " | 3.7 | " | 0.06 | 417 | 151 | 0.04 | Invention |
| 53 | " | 3.7 | " | 0.12 | 457 | 174 | 0.04 | Invention |
| 54 | (III-1) | 3.7 | (I-9) | 0.12 | 295 | 107 | 0.04 | Invention |
| 55 | " | 3.7 | " | 0.24 | 380 | 123 | 0.04 | Invention |
| 56 | " | 3.7 | " | 0.48 | 426 | 132 | 0.04 | Invention |

As shown in Table 4, it can be seen that as shown in Test Nos. 40 to 44, the sensitizing dye for use in this invention shows a high sensitivity for the silver iodobromide emulsion as compared to the comparison sensitizing dye having the similar structure thereto but is liable to form fog. However, it can be seen that as shown in Test Nos. 51 to 56, the sensitizing dye of formula (I) for use in this invention shows a very high sensitivity in the case of using the sensitizing dye of formula (III) even by using a small amount thereof without increasing fog. Also, from the results of Table 4, it can be seen that use of the sensitizing dyes in this invention is an excellent spectral sensitizing technique for a silver iodobromide emulsion.

EXAMPLE 5

A silver halide emulsion was prepared by the same procedure as in Example 2, split into several parts, and $2.5\times10^{-4}$ mol of the sensitizing dye (III-9) per mol of silver halide and the sensitizing dye shown in Table 5 were added to each sample emulsion at 40° C. followed by stirring for 15 minutes.

Then, each emulsion was coated on a paper support both the surfaces of which were coated with polyethylene by the same manner as in Example 2 to provide a coated sample and each sample was exposed and processed as in Example 2.

The results obtained are shown in Table 5.

The evaluation of the photographic property was performed by a relative sensitivity among the samples containing a same coupler and the sensitivity of the sample containing the comparison compound (RS-4) as shown in Example 3 was defined as 100. The standard point of the optical density of determining the sensitivity was a point of (fog+0.5).

TABLE 5

| Test No. | Sensitizing Dye and Amount $\times 10^{-5}$ mol/mol-Ag | | Coupler and Amount g/mol-Ag | | Relative Sensitivity | Fog | Note |
|---|---|---|---|---|---|---|---|
| 3-1 | (RS-4) | 2.5 | (C-4) | 21.6 | 100 (standard) | 0.10 | Comparison Magenta coupler |
| 3-2 | " | 5.0 | " | 21.6 | 112 | 0.10 | |
| 3-3 | " | 10.0 | " | 21.6 | 107 | 0.11 | |
| 3-4 | (I-1) | 1.0 | (C-4) | 21.6 | 182 | 0.10 | Comparison Magenta coupler |
| 3-5 | " | 2.0 | " | 21.6 | 191 | 0.10 | |
| 3-6 | " | 4.0 | " | 21.6 | 204 | 0.11 | |
| 3-7 | (RS-5) | 2.5 | (C-1) | 21.6 | 100 (standard) | 0.12 | Comparison Magenta coupler |
| 3-8 | " | 5.0 | " | 21.6 | 115 | 0.12 | |
| 3-9 | " | 10.0 | " | 21.6 | 110 | 0.13 | |
| 3-10 | (I-1) | 1.0 | (C-1) | 21.6 | 191 | 0.12 | Comparison Magenta coupler |
| 3-11 | " | 2.0 | " | 21.6 | 204 | 0.12 | |
| 3-12 | " | 4.0 | " | 21.6 | 200 | 0.12 | |
| 3-13 | (RS-4) | 2.5 | (C-5) | 21.6 | 100 (standard) | 0.08 | Comparison Cyan coupler |
| 3-14 | " | 5.0 | " | 21.6 | 112 | 0.08 | |
| 3-15 | " | 10.0 | " | 21.6 | 110 | 0.08 | |
| 3-16 | (I-1) | 1.0 | (C-5) | 21.6 | 186 | 0.08 | Comparison Cyan coupler |
| 3-17 | " | 2.0 | " | 21.6 | 195 | 0.08 | |
| 3-18 | " | 4.0 | " | 21.6 | 200 | 0.08 | |
| 3-19 | (RS-4) | 2.5 | (C-6) | 21.6 | 100 (standard) | 0.07 | Comparison Cyan coupler |
| 3-20 | " | 5.0 | " | 21.6 | 115 | 0.07 | |
| 3-21 | " | 10.0 | " | 21.6 | 112 | 0.08 | |
| 3-22 | (I-1) | 1.0 | (C-6) | 21.6 | 191 | 0.07 | Comparison Cyan coupler |
| 3-23 | " | 2.0 | " | 21.6 | 214 | 0.07 | |
| 3-24 | " | 4.0 | " | 21.6 | 204 | 0.07 | |
| 3-25 | (RS-4) | 2.5 | (C-3) | 50.4 | 100 (standard) | 0.11 | Comparison Yellow coupler |
| 3-26 | " | 5.0 | " | 50.4 | 126 | 0.11 | |
| 3-27 | " | 10.0 | " | 50.4 | 117 | 0.12 | |
| 3-28 | (I-1) | 1.0 | (C-3) | 50.4 | 191 | 0.11 | Comparison Yellow coupler |
| 3-29 | " | 2.0 | " | 50.4 | 240 | 0.11 | |
| 3-30 | " | 4.0 | " | 50.4 | 229 | 0.12 | |

The chemical structures of the couplers used in the example were as follows.

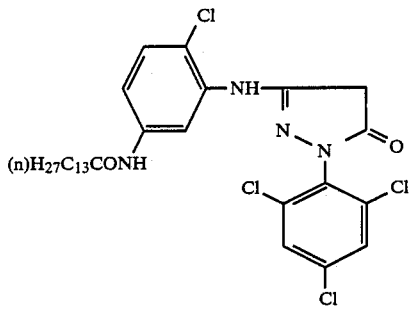

(C-4)

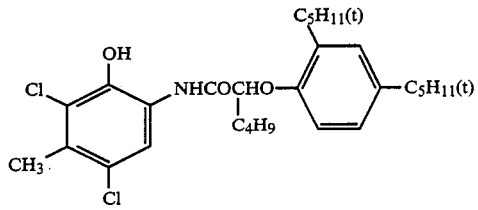

(C-5)

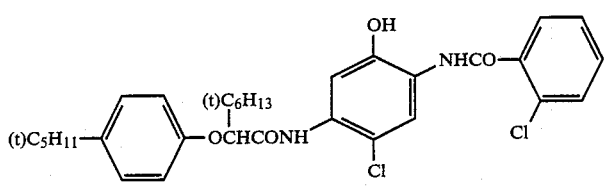

(C-6)

As shown in Table 5, it can be seen that the sample containing the sensitizing dye of formula (I) for use in this invention shows high sensitivity as compared with the sample containing comparison compound (RS-4). Thus the present invention is excellent.

EXAMPLE 6

Each of multilayer color photographic materials (Samples 6-1 to 6-6) was prepared by forming the layers having the compositions shown below on a cellulose triacetate film support of 127 μm in thickness having a subbing layer.

| | |
|---|---|
| Layer 1: Antihalation layer | |
| A gelatin layer (dry thickness of 2 μm) containing; | |
| Black Colloid | 0.25 g/m$^2$ |
| Ultraviolet Absorbent U-1 | 0.04 g/m$^2$ |
| Ultraviolet Absorbent U-2 | 0.1 g/m$^2$ |
| Ultraviolet Absorbent U-3 | 0.1 g/m$^2$ |
| High-Boiling Point Organic Solvent O-1 | 0.1 g/m$^2$ |
| Layer 2: Interlayer | |
| A gelatin layer (dry thickness of 1 μm) containing; | |
| A-14 | 2.5 g/m$^2$ |
| Compound H-1 | 0.05 g/m$^2$ |
| Emulsion A | 0.05 g/m$^2$ as Ag |
| High-Boiling Point Organic Solvent O-2 | 0.05 g/m$^2$ |
| Layer 3: 1st Red-Sensitive Emulsion Layer | |
| A gelatin layer (dry thickness of 0.7 μm) containing; | |
| Mono-Dispersed Silver Iodobromide Emulsion (X-1) (iodine content 4 mol %, mean grain size 0.20 μm, coefficient variation on grain sizes of 12%) spectrally sensitized by Sensitizing Dye III-1 (5.94 × 10$^{-4}$ mol/mol-Ag, 0.47 mg/m$^2$) and Compound RS-6 or I-1 (addition amounts shown in Table 4-1) | 0.15 g/m$^2$ as Ag |

-continued

| | |
|---|---|
| Mono-Dispersed Internal Latent Image Type Silver Iodobromide Emulsion (X-2) (iodine content 4 mol %, mean grain size 0.40 μm, distance from latent image to grain surface 100Å, variation coefficient 14%) spectrally sensitized by Sensitizing Dye III-1 (4.83 × 10$^{-4}$ mol/mol-Ag, 0.51 mg/m$^2$) and Compounds RS-6 or I-1 (amounts shown in Table 4-1 | 0.20 g/m$^2$ |
| Emulsion B | 0.05 g as Ag |
| A-1 | 0.60 g/m$^2$ |
| Coupler C-7 | 0.13 g/m$^2$ |
| Coupler C-8 | 0.033 g/m$^2$ |
| Coupler C-16 | 0.1 g/m$^2$ |
| High-Boiling Point Organic Solvent O-2 | 0.08 g/m$^2$ |
| Layer 4: 2nd Red-Sensitive Emulsion Layer | |
| A gelatin layer (dry thickness of 1.7 μm) containing; | |
| Mono-Dispersed Silver Iodobromide Emulsion (X-3) (iodine content 3 mol %, mean grain size 0.55 μm, variation coefficient 16%) spectrally sensitized by Sensitizing Dye III-1 (3.94 × 10$^{-4}$ mol/mol-Ag, 1.1 mg/m$^2$) and Compounds RS-6 or I-1 (amounts shown in Table 4-1) | 0.53 g/m$^2$ |
| A-4 | 0.02 g/m$^2$ |
| Coupler C-7 | 0.40 g/m$^2$ |
| Coupler C-8 | 0.07 g/m$^2$ |
| Coupler C-15 | 0.05 g/m$^2$ |
| High-Boiling Point Organic Solvent O-2 | 0.22 g/m$^2$ |
| Layer 5: 3rd Red-Sensitive Emulsion Layer | |
| A gelatin layer (dry thickness of 1.8 μm) containing; | |
| Mono-Dispersed Siver Iodobromide Emulsion (X-4) (iodine content 2 mol %, mean grain size 0.07 μm, variation coefficient 17%) spectrally sensitized by Sensitizing Dye III-1 (3.94 × 10$^{-4}$ mol/mol-Ag, 1.1 mg/m$^2$) and Compounds RS-6 or I-1 (amounts shown in Table 4-2) | 0.53 g/m$^2$ |
| A-7 | 0.2 g/m$^2$ |

-continued

| | |
|---|---|
| Coupler C-12 | 0.35 g/m$^2$ |
| Coupler C-14 | 0.20 g/m$^2$ |
| High-Boiling Point Organic Solvent O-2 | 0.24 g/m$^2$ |
| Layer 6: Interlayer | |
| A gelatin layer (dry thickness of 1 μm) containing; | |
| A-10 | 10 mg/m$^2$ |
| A-11 | 5 mg/m$^2$ |
| Compound H-1 | 0.1 g/m$^2$ |
| High-Boiling Point Organic Solvent O-2 | 0.1 g/m$^2$ |
| Layer 7: 1st Green-Sensitive Emulsion Layer | |
| A gelatin layer (dry thickness of 0.7 μm) containing; | |
| Mono-Dispersed Silver Iodobromide Emulsion (iodine content 3 mol %, mean grain size 0.35 μm, variation coefficient 19%) spectrally sensitized by Sensitizing Dye S-2 (2.2 mg/m$^2$) and Compounds S-3 (1.0 mg/m$^2$) | 0.5 g/m$^2$ as Ag |
| Emulsion B | 0.05 g/m$^2$ as Ag |
| A-5 | 0.12 g/m$^2$ |
| Coupler C-9 | 0.27 g/m$^2$ |
| High-Boiling Point Organic Solvent O-2 | 0.17 g/m$^2$ |
| Layer 8: 2nd Green-Sensitive Emulsion Layer | |
| A gelatin layer (dry thickness of 1.7 μm) containing; | |
| Mono-Dispersed Internal Latent Image Type Silver Iodobromide Emulsion (iodine content 2.5 mol %, mean grain size 0.5 μm, variation coefficient 18%, distance from latent image to grain surface 100 Å) spectrally sensitized by Sensitizing Dye S-2 (0.29 mg/m$^2$) and S-3 (0.3 mg/m$^2$) | 0.5 g/m$^2$ |
| A-6 | 0.2 g/m$^2$ |
| Coupler C-9 | 0.2 g/m$^2$ |
| High-Boiling Point Organic Solvent O-2 | 0.13 ml/m$^2$ |
| Layer 9: 3rd Green-Senstive Emulsion Layer | |
| A gelatin layer (dry thickness of 1.7 μm) containing; | |
| Tabular Grain Silver Iodobromide Emulsion (iodine content 2 mol %, grains having aspect ratio of at least 7 account for 50% of the projected area of whole grains, mean thickness of grains 0.10 μm) spectrally sensitized by Sensitizing Dye S-2 (0.9 g/m$^2$) and S-3 (0.3 mg/m$^2$) | 0.5 g/m$^2$ |
| A-2 | 1.5 g/m$^2$ |
| Coupler C-9 | 0.2 g/m$^2$ |
| High-Boiling Point Organic Solvent O-2 | 0.03 g/m$^2$ |
| Layer 10: Yellow Filter Layer | |
| A gelatin layer (dry thickness of 1 μm) containing; | |
| Yellow Colloid Silver | 0.05 g/m$^2$ |
| Compound A-15 | 0.22 g/m$^2$ |
| Compound H-1 | 0.02 g/m$^2$ |
| Compound H-2 | 0.03 g/m$^2$ |

-continued

| | |
|---|---|
| High-Boiling Point Organic Solvent O-2 | 0.04 ml/m$^2$ |
| Layer 11: 1st Blue-Sensitive Emulsion Layer | |
| A gelatin layer (dry thickness of 1.5 μm) containing; | |
| Tabular Grain Silver Iodobromide Emulsion (iodine content 3 mol %, grains having aspect ratio of at least 7 account for 50% of the projected area of whole grains, mean thickness of grains 0.10 μm) spectrally sensitized by Sensitizing Dye S-4 (1.0 g/m$^2$) | 0.6 g/m$^2$ as Ag |
| Emulsion A | 0.1 g/m$^2$ |
| A-7 | 0.5 g/m$^2$ |
| Coupler C-11 | 0.5 g/m$^2$ |
| High-Boiling Point Organic Solvent O-2 | 0.1 ml/m$^2$ |
| Layer 12: 2nd Blue-Sensitive Emulsion Layer | |
| A gelatin layer (dry thickness of 3 μm) containing; | |
| Tabular Grain Silver Iodobromide Emulsion (iodine content 2.5 mol %, grains having aspect ratio of at least 7 account for 50% of the projected area of whole grains, mean thickness of grains 0.15 μm) spectrally sensitized by Sensitizing Dye S-4 (2.0 g/m$^2$) | 1.1 g/m$^2$ as Ag |
| A-12 | 10 g/m$^2$ |
| Coupler C-13 | 1.2 g/m$^2$ |
| Coupler C-14 | 0.2 g/m$^2$ |
| High-Boiling Point Organic Solvent O-2 | 0.23 ml/m$^2$ |
| Layer 13: 1st Protective Layer | |
| A gelatin layer (dry thickness of 2 μm) containing; | |
| A-13 | 0.01 mg/m$^2$ |
| Ultraviolet absorbent U-1 | 0.02 g/m$^2$ |
| Ultraviolet absorbent U-2 | 0.03 g/m$^2$ |
| Ultraviolet absorbent U-3 | 0.03 g/m$^2$ |
| Ultraviolet absorbent U-4 | 0.29 g/m$^2$ |
| High-Boiling Point Organic Solvent O-2 | 0.28 ml/m$^2$ |
| Layer 14: | |
| 2nd Protective Layer | 0.1 g/m$^2$ |
| Surface-Fogged Fine Grain Silver Iodobromide Emulsion (iodine content 1 mol %, mean grain size 0.06 μm) | as Ag |
| Yellow Colloid Silver for Yellow Filter Layer | 0.01 g/m$^2$ as Ag |
| A-8 | 10 g/m$^2$ |
| Polymethyl Methacrylate Particles (mean particle size 1.5 μm) | 0.1 g/m$^2$ |
| A-9 | 1.0 g/m$^2$ |

Each layer further contained a formalin antifoggant A-3, a gelatin hardening agent H-3, and a surface active agent in addition to the aforesaid components.

The compounds used for preparing the samples are shown below.

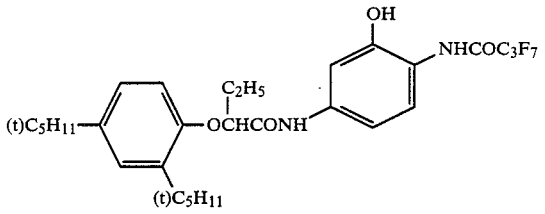

C-7

-continued
C-8
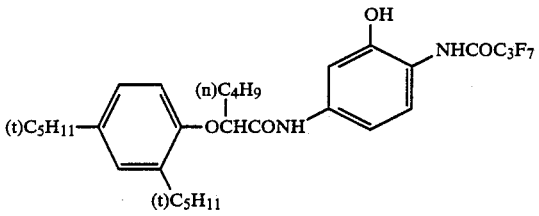
C-9
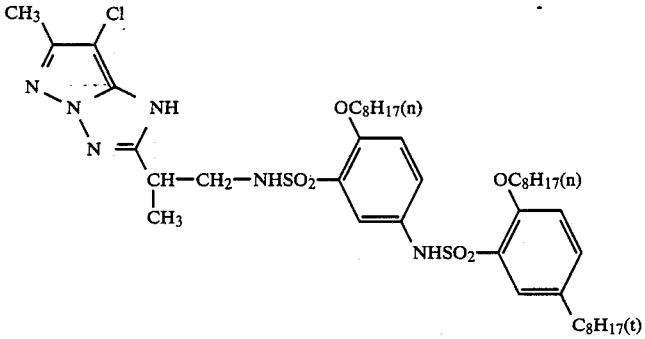
C-10
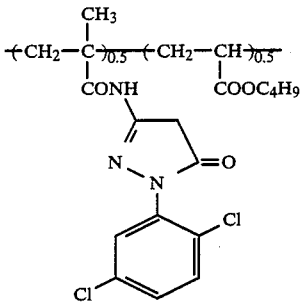
C-11
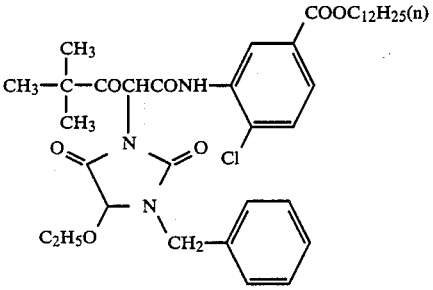
C-12
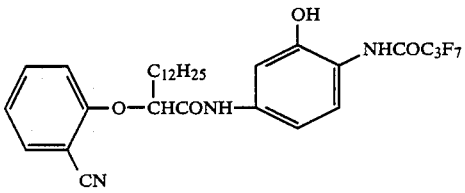
C-13
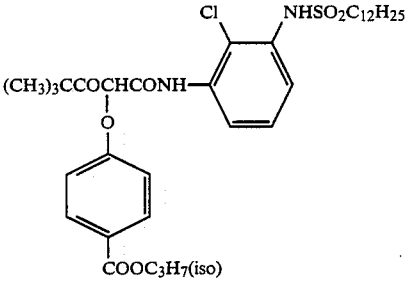

-continued
C-14
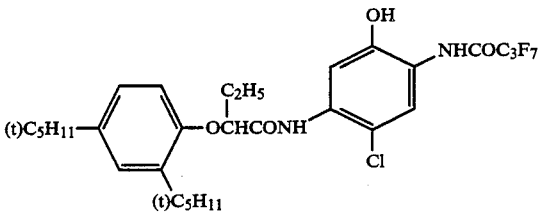
C-15
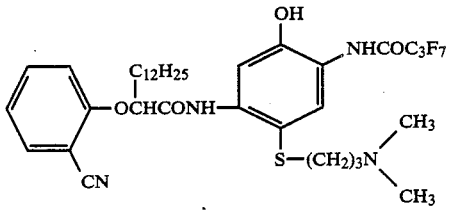
C-16
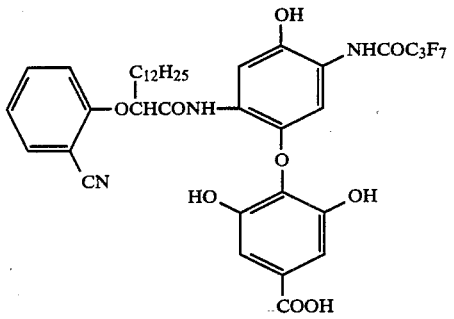
U-1
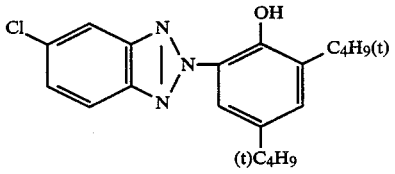
U-2
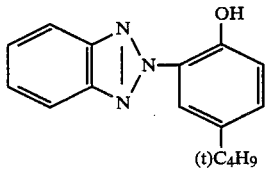
U-3
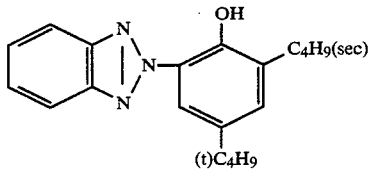
U-4
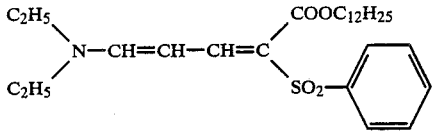
H-1
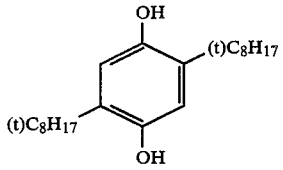

-continued
H-2
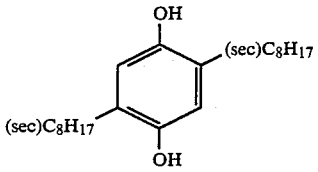
H-3
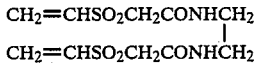
O-1
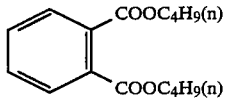
O-2
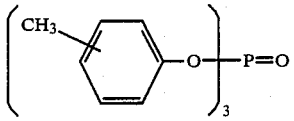
RS-6
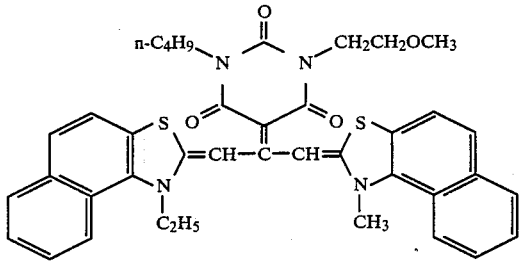
S-2
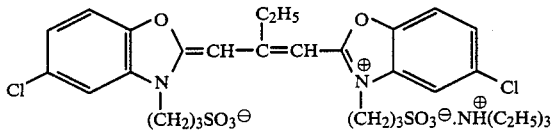
S-3
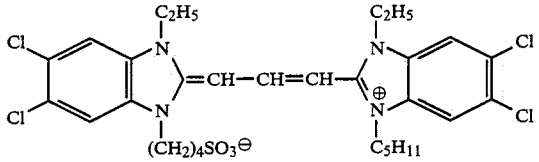
S-4
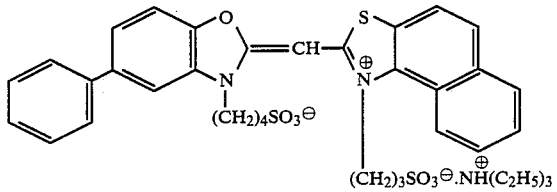
A-1
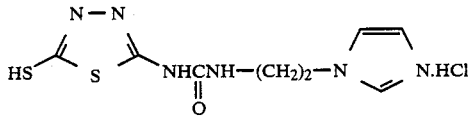
A-2
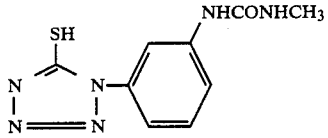

-continued
A-3
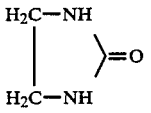
A-4
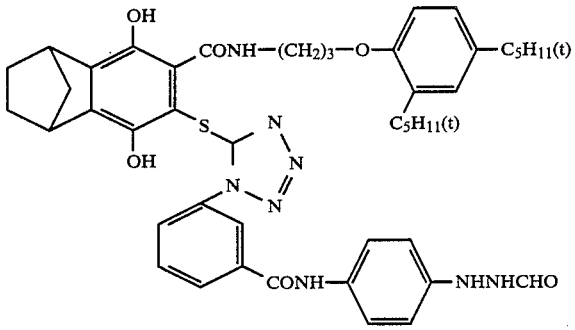
A-5
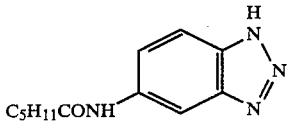
A-6
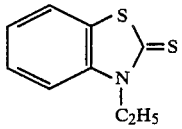
A-7
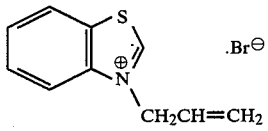
A-8
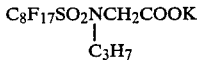
A-9
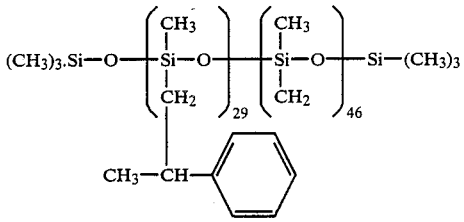
A-10
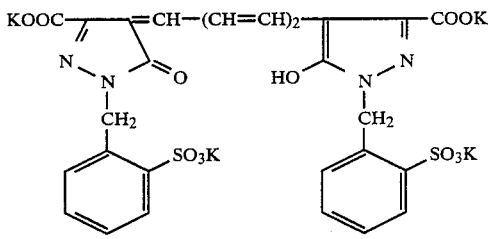
A-11
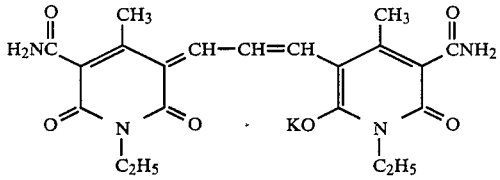

-continued

A-12

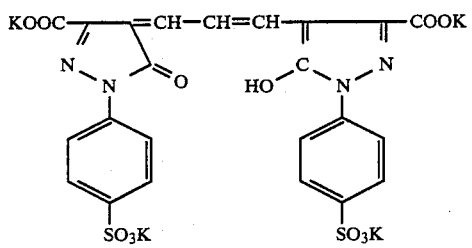

A-13

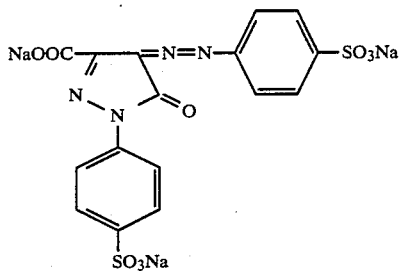

A-14

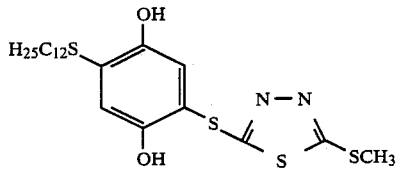

A-15

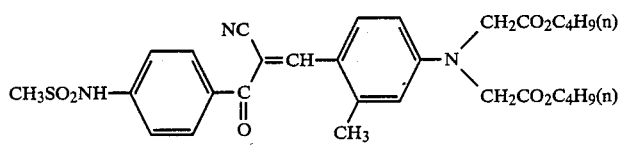

Preparation of Emulsions A and B used:

A silver bromide emulsion containing cubic grains having a mean grain size of 0.15 μm was prepared by a controlled double jet method and the emulsion was fogged using hydrazine and a gold complex salt at a low pAg to provide Emulsion A.

A shell of silver bromide was formed at a thickness of 50 Å on the silver halide grain of Emulsion A thus prepared to provide Emulsion B.

The sensitizing dyes added to Emulsions (X-1), (X-2), (X-3) and (X-4) used for the samples are shown in Table 6-1 together with the addition amounts thereof.

TABLE 6-1

| Test No. | Sensitizing Dye added to Emulsion (X-1) $\times 10^{-5}$ mol/mol-Ag | | Sensitizing Dye added to Emulsion (X-2) $\times 10^{-5}$ mol/mol-Ag | | Sensitizing Dye added to Emulsion (X-3) $\times 10^{-5}$ mol/mol-Ag | | Sensitizing Dye added to Emulsion (X-4) $\times 10^{-5}$ mol/mol-Ag | |
|---|---|---|---|---|---|---|---|---|
| 6-1 | (RS-6) | 1.40 | (RS-6) | 1.56 | (RS-6) | 0.80 | (RS-6) | 0.80 |
| 6-2 | " | 2.10 | " | 2.34 | " | 1.20 | " | 1.20 |
| 6-3 | " | 3.15 | " | 3.51 | " | 1.80 | " | 1.80 |
| 6-4 | (I-1) | 0.56 | (I-1) | 0.63 | (I-1) | 0.32 | (I-1) | 0.32 |
| 6-5 | " | 0.84 | " | 0.95 | " | 0.48 | " | 0.48 |
| 6-6 | " | 1.26 | " | 1.42 | " | 0.72 | " | 0.72 |

Each of the samples thus prepared was exposed to white light through a continuous wedge, processed by the process shown below, and the cyan magenta, and yellow densities were measured.

Also, the logarisms (log E) of the exposure amounts necessary for coloring a cyan density of 1.0 were obtained to compare the relative sensitivities. The results obtained are shown in Table 6-2.

TABLE 6-2

| Test No. | Relative Sensitivity | Note |
|---|---|---|
| 6-1 | 100 (standard) | Comparison |
| 6-2 | 112 | " |
| 6-3 | 107 | " |
| 6-4 | 155 | Invention |
| 6-5 | 174 | " |
| 6-6 | 170 | " |

(Test Nos. correspond to the coated sample Nos. in Table 6-1)

As is clear from the results shown in Table 6-2, it can be seen that the samples using the combination of the sensitizing dyes in this invention have a very high sensitivity.

The photographic performance of Sample Nos 6-4 to 6-6, such as graininess, sharpness, fog, development progressivity, etc., other than the sensitivity were almost same as those of the comparison samples.

The processing process used in the example was as follows.

| Processing Step | Time | Temperature |
|---|---|---|
| First Development | 60 sec. | 38° C. |
| First Wash | 60 sec. | 33° C. |
| Color Development | 90 sec. | 38° C. |
| Bleach | 60 sec. | 38° C. |
| Blix | 60 sec. | 38° C. |
| Second Wash | 60 sec. | 33° C. |
| Drying | 45 sec. | 75° C. |

The composition of the processing solutions used for the above process were as follows.

First Developer

| | Mother Liquid | Replenisher |
|---|---|---|
| Nitriolo-N,N,N-trimethylene phosphonium.penta-sodium salt | 1.0 g | 1.0 g |
| Diethylenetriaminepentaacetic acetic Acid.Peta-Sodium Salt | 3.0 g | 3.0 g |
| Potassium Sulfite | 30.0 g | 30.0 g |
| Potassium Thiocyanate | 1.2 g | 1.2 g |
| Potassium Carbonate | 35.0 g | 35.0 g |
| Potassium Hydroquinone-mono-sulfonate | 25.0 g | 25.0 g |
| 1-Phenyl-3-pyrazolidone | 2.0 g | 2.0 g |
| Potassium Bromide | 0.5 g | — |
| Potassium Iodide | 5.0 mg | — |
| Water to make | 1,000 ml | 1,000 ml |
| pH | 9.60 | 9.70 |

pH adjusted by hydrochloric acid or potassium hydroxide.

First Wash Solution

| | Mother Liquid | Replenisher |
|---|---|---|
| Ethylenediaminetetramethylene-phosphoric acid | 2.0 g | Same as the mother Liquor |
| Di-sodium Phosphate | 5.0 g | |
| Water to make | 1,000 ml | |
| pH | 7.00 | |

pH adjusted by hydrochloric acid or potassium hydroxide.

Color Developer

| | Mother Liquid | Replenisher |
|---|---|---|
| Benzyl Alcohol | 15.0 ml | 18.0 ml |
| Diethylene Glycol | 12.0 ml | 14.0 ml |
| 3,6-Dithia-1,8-octane | 2.00 g | 2.50 g |
| Nitrilo-N,N,N-trimethylene-phosphonic Acid.Penta-sodium Salt | 0.5 g | 0.5 g |
| Diethylenetriaminepetaacetic Acid.Penta-sodium Salt | 2.0 g | 2.0 g |
| Sodium Sulfite | 2.0 g | 2.5 g |
| Hydroxylamine Sulfate | 3.0 g | 3.6 g |
| N-Ethyl-N-(β-methanesulfonamido-ethyl)-3-methylaminoaniline Sulfate | 6.0 g | 9.0 g |
| Ethylenediamine | 10.0 ml | 12.0 ml |
| Fluorescent Whitening Agent (diaminostilbene series) | 1.0 g | 1.2 g |
| Potassium Bromide | 0.5 g | — |
| Potassium Iodide | 1.0 mg | — |
| Water to make | 1,000 ml | 1,000 ml |
| pH | 10.60 | 1.00 |

pH adjusted by hydrochloric acid or potassium hydroxide.

Bleach Solution

| | Mother Liquid | Replenisher |
|---|---|---|
| Ethylenediaminetetraacetic Acid.Di-Sodium Salt | 10.0 g | Same as the mother Liquor |

-continued

| | | |
|---|---|---|
| Ethylenediaminetetraacetic Acid.Fe(III).Ammonium Di-Hydrate | 120 g | |
| | 120 g | |
| Ammonium Bromide | 100 g | |
| Ammonium Nitrate | 10 g | |
| Water to make | 1,000 ml | |
| pH | 6.30 | |

pH adjusted by acetic acid or aqueous ammonia.

Blix Solution

| | Mother Liquid | Replenisher |
|---|---|---|
| Ethylenediaminetetraacetic Acid.Di-Sodium Di-Hydrate | 5.0 g | Same as the mother Liquor |
| Ethylenediaminetetraacetic Acid.Fe(III).Ammonium.mono-Hydrate | 80.0 g | |
| Sodium Sulfite | 15.0 g | |
| Ammonium thiosulfate (700 g/liter) | 160 ml | |
| 2-Mercapto-1,3,4-triazole | 0.5 g | |
| Water to make | 1,000 ml | |
| pH | 6.50 | |

pH adjusted by acetic acid or aqueous ammonia.

Second Wash Solution

Mother liquor and Replenisher were common.

City water passed through a mixed bed column packed with a H-type strong acid cation exchange resin (Amberlite IR-120B, made by Rhom & Haas Co.) and an OH-type anion exchange resin (Amberlite IR-400) to reduce the contents of calcium ions and magnesium ions below 3 mg/liter and then 20 mg/liter of sodium dichloroisocyanurate and 1.5 g/liter of sodium sulfate were added thereto. The pH of the solution was in the range of from 6.5 to 7.5.

EXAMPLE 7

Each of multilayer color photographic materials (Samples 7-1 to 7-6) having the layers of the following compositions on a cellulose triacetate film support having a subbing layer was prepared.

Composition of Layers:

The numerals corresponding to the components show coating amounts shown by a g/m$^2$ unit, wherein the amount of silver halide emulsion is shown by the coating amount of silver calculated and the amount of the sensitizing dye is shown by the mol unit to mol of the silver halide in the same emulsion layer.

| | |
|---|---|
| Layer 1: Antihalation layer | |
| Black Colloidal Silver | 0.18 as Ag |
| Gelatin | 0.40 |
| Layer 2: Interlayer | |
| 2,5-di-t-pentadecylhydroquinone | 0.18 |
| C-17 | 0.07 |
| C-19 | 0.02 |
| U-5 | 0.08 |
| U-6 | 0.08 |
| O-2 | 0.10 |
| O-1 | 0.02 |
| Gelatin | 1.04 |
| Layer 3: 1st Red-Sensitive Emulsion Layer | |
| Silver Iodobromide Emulsion (X-5) (silver iodide content 6 mol %, mean grain size 0.8 μm) | 0.55 as Ag |
| Sensitizing Dye (III-9) | $2.30 \times 10^{-4}$ |
| Sensitizing Dye (I-1 or RS-6) | shown in Table 7-1 |
| C-18 | 0.350 |
| O-2 | 0.005 |
| C-27 | 0.015 |
| Gelatin | 1.20 |

-continued

| | |
|---|---|
| Layer 4: 2nd Red-Sensitive Emulsion Layer | |
| Silver Iodobromide Emulsion (X-6) (silver iodide content 8 mol %, mean grain size 0.85 μm) | 1.20 as Ag |
| Sensitizing Dye (III-9) | $2.20 \times 10^{-4}$ |
| Sensitizing Dye (I-1 or RS-6) | shown in Table 7-1 |
| C-18 | 0.300 |
| C-19 | 0.050 |
| C-20 | 0.050 |
| C-27 | 0.004 |
| O-1 | 0.050 |
| Gelatin | 1.30 |
| Layer 5: 3rd Red-Sensitive Emulsion Layer | |
| Silver Iodobromide Emulsion (X-7) (silver iodide content 14 mol %, mean grain size 1.5 μm) | 1.60 as Ag |
| Sensitizing Dye (III-9) | $2.00 \times 10^{-4}$ |
| Sensitizing Dye (I-1 or RS-6) | shown in Table 7-1 |
| C-21 | 0.215 |
| C-19 | 0.055 |
| C-26 | 0.005 |
| O-2 | 0.32 |
| Gelatin | 1.63 |
| Layer 6: Interlayer | |
| Gelatin | 1.06 |
| Layer 7: 1st Green-Sensitive Emulsion Layer | |
| Silver Iodobromide Emulsion (silver iodide content 6 mol %, mean grain size 0.8 μm) | 0.40 as Ag |
| Sensitizing Dye (S-5) | $3.0 \times 10^{-5}$ |
| Sensitizing Dye (S-6) | $1.0 \times 10^{-4}$ |
| Sensitizing Dye (S-7) | $3.8 \times 10^{-4}$ |
| C-22 | 0.260 |
| C-17 | 0.021 |
| C-23 | 0.030 |
| C-24 | 0.025 |
| O-2 | 0.100 |
| Gelatin | 0.75 |
| Layer 8: 2nd Green-Sensitive Emulsion Layer | |
| Silver Iodobromide Emulsion (silver iodide content 9 mol %, mean grain size 0.85 μm) | 0.80 as Ag |
| Sensitizing Dye (S-5) | $2.1 \times 10^{-5}$ |
| Sensitizing Dye (S-6) | $7.0 \times 10^{-4}$ |
| Sensitizing Dye (S-9) | $2.6 \times 10^{-4}$ |
| C-22 | 0.150 |
| C-24 | 0.010 |
| C-17 | 0.008 |
| C-23 | 0.012 |
| O-2 | 0.60 |
| Gelatin | 1.10 |
| Layer 9: 3rd Green-Sensitive Emulsion Layer | |
| Silver Iodobromide Emulsion (silver iodide content 12 mol %, mean grain size 1.3 μm) | 1.2 as Ag |
| Sensitizing Dye (S-5) | $3.5 \times 10^{-5}$ |
| Sensitizing Dye (S-6) | $8.0 \times 10^{-5}$ |
| Sensitizing Dye (S-9) | $3.0 \times 10^{-4}$ |
| C-28 | 0.065 |
| C-17 | 0.025 |
| O-1 | 0.55 |
| Gelatin | 1.74 |
| Layer 10: Yellow Filter Layer | |
| Yellow Colloidal Silver | 0.05 as Ag |

-continued

| | |
|---|---|
| 2,5-Di-t-pentadecylhydroquinone | 0.03 |
| Gelatin | 0.95 |
| Layer 11: 1st Blue Sensitive Emulsion Layer | |
| Silver Iodobromide Emulsion (silver iodide content 6 mol %, mean grain size 0.6 μm) | 0.24 as Ag |
| Sensitizing Dye (S-8) | $3.5\ 1 \times 10^{-4}$ |
| C-25 | 0.85 |
| C-24 | 0.12 |
| O-2 | 0.28 |
| Gelatin | 1.28 |
| Layer 12: 2nd Blue-Sensitive Emulsion Layer | |
| Silver Iodobromide Emulsion (silver iodide content 10 mol %, mean grain size 1.0 μm) | 0.45 as Ag |
| Sensitizing Dye (S-8) | $3.5 \times 10^{-4}$ |
| C-25 | 0.20 |
| C-26 | 0.015 |
| O-2 | 0.03 |
| Gelatin | 0.46 |
| Layer 13: 3rd Blue Sensitive Emulsion Layer | |
| Silver Iodobromide Emulsion (silver iodide content 10 mol %, mean grain size 1.8 μm) | 0.77 as Ag |
| Sensitizing Dye (S-10) | $1.1 \times 10^{-4}$ |
| Sensitizing Dye (S-11) | $1.1 \times 10^{-4}$ |
| C-25 | 0.20 |
| O-1 | 0.07 |
| Gelatin | 0.69 |
| Layer 14: 1st Protective Layer | |
| Silver Iodobromide Emulsion (silver iodide content 1 mol %, mean grain size 0.07 μm) | 0.5 as Ag |
| U-5 | 0.11 |
| U-6 | 0.17 |
| O-2 | 0.90 |
| Gelatin | 1.00 |
| Layer 15: 2nd Protective Layer | |
| Polymethyl Acrylate Particles (diameter about 1.5 μm) | 0.54 |
| A-16 | 0.05 |
| A-3 | 0.20 |
| Gelatin | 0.72 |

Each layer further contained a gelatin hardening agent H-3, a stabilizer A-17, and a surface active agent in addition to the aforesaid components.

The chemical structures or chemical names of the compounds used above (except those already described in previous examples) are shown below.

The sensitizing dyes added to Emulsions (X-5), (X-6), and (X-7) in addition to the sensitizing dye (III-9) are shown in the following table.

TABLE 7-1

| Coated Sample | Sensitizing Dye added to Emulsion (X-5) $\times 10^{-5}$ mol/mol-Ag | | Sensitizing Dye added to Emulsion (X-6) $\times 10^{-5}$ mol/mol-Ag | | Sensitizing Dye added to Emulsion (X-7) $\times 10^{-5}$ mol/mol-Ag | |
|---|---|---|---|---|---|---|
| 7-1 | (RS-6) | 1.53 | (RS-6) | 1.47 | (RS-6) | 1.33 |
| 7-2 | (RS-6) | 2.30 | (RS-6) | 2.20 | (RS-6) | 2.00 |
| 7-3 | (RS-6) | 3.45 | (RS-6) | 3.30 | (RS-6) | 3.00 |
| 7-4 | (I-1) | 0.77 | (I-1) | 0.73 | (I-1) | 0.67 |
| 7-5 | (I-1) | 1.15 | (I-1) | 1.10 | (I-1) | 1.00 |
| 7-6 | (I-1) | 1.73 | (I-1) | 1.65 | (I-1) | 1.50 |

Each of Samples 7-1 to 7-6 thus prepared was exposed to a light source having color temperature of 4,800° K. for 1/100 second, processed by the process shown below, and the cyan density was measured using a densitometer made by Fuji Photo Film Co., Ltd. to determine the sensitivity and fog. The standard point of the optical density for determining the sensitivity was a point of (fog+0.2).

The results obtained are shown in Table 7-2 below

The processing process was as follows and each step (except drying) was performed at 38° C.

| Processing Step | Time |
|---|---|
| Color Development | 3 min. 15 sec. |
| Bleach | 1 min. |
| Blix | 3 min. 15 sec. |
| Wash (1) | 40 sec. |
| Wash (2) | 1 min. |
| Stabilization | 40 sec. |
| Drying (50° C.) | 1 min 15 sec. |

In the above process, for the wash step, a counter-current washing system of from wash (2) to wash (1) was employed.

The composition of each processing solution is shown below.

In addition, the amount of the replenisher for each processing solution was 1,200 ml per square meters of a color photographic material for the color developer and ml for other processing solution (including wash solution). Also, the amount of the blix solution carried in the wash step was 50 ml per square meters of the color photographic material.

| Color Developer | Mother Liquid | Replenisher |
|---|---|---|
| Diethylenetriaminepentaacetic Acid | 1.0 g | 1.1 g |
| 1-Hydroxyethylidene-1,1-diphosphonic Acid | 2.0 g | 2.2 g |
| Sodium Sulfite | 4.0 g | 4.4 g |
| Potassium Carbonate | 30.0 g | 32.0 g |
| Potassium Bromide | 1.4 g | 0.7 g |
| Potassium Iodide | 1.3 mg | — |
| Hydroxylamine Sulfate | 2.4 g | 21.6 g |
| 4-(N-Ethyl-N-β-hydroxyethylamino)-2-methylaniline Sulfate | 4.5 g | 5.0 g |
| Water to make | 1,000 ml | 1,000 ml |

-continued

| pH | 10.0 | 10.05 |
|---|---|---|
| Bleach Solution | | Both Mother liquor and Replenisher |
| Ethylenediaminetetraacetic Acid Ferric Ammonium Salt | | 120.0 g |
| Ethylenediaminetetraacetic Acid Di-Sodium Salt | | 10.0 g |
| Ammonium Nitrate | | 10.0 g |
| Ammonium Bromide | | 100.0 g |
| Bleach accelerator (shown below) | | $5 \times 10^{-3}$ mol |

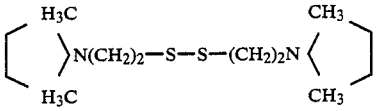

| | |
|---|---|
| pH adjusted to 6.3 with aqueous ammonia | |
| Water to make | 1.0 liter |
| Blix Solution | Both Mother liquor and Replenisher |
| Ethylenediaminetetraacetic Acid Ferric Ammonium Salt | 50.0 g |
| Ethylenediaminetetraacetic Acid Di-Sodium Salt | 5.0 g |
| Sodium Sulfite | 12.0 g |
| Aqueous Ammonium Thiosulfate Solution (70%) | 240 ml |
| pH adjusted to 7.3 with aqueous ammonia | |
| Water to make | 1.0 liter |
| Wash Water | Both Mother liquor and Replenisher |

City water containing 32 mg/liter of calcium ion and 7.3 mg/liter of magnesium ion was passed through a column packed with a H-type strong acid cation exchange resin and an OH-type strong basic anion exchange resin to reduce 1.2 mg/liter of calcium ion and 0.4 mg/liter of magnesium ion and sodium dichloroisocyanurate was added to the water at 20 mg per liter of water.

| Stabilizer | Both Mother liquor and Replenisher |
|---|---|
| Formalin (37% v/w) | 2.0 ml |
| Polyoxyethylene-p-monononyl Phenyl Ether (mean polymerization degree 10) | 0.3 g |
| Ethylenediaminetetraacetic Acid Di-Sodium Salt | 0.05 g |
| Water to make | 1.0 liter |
| pH | 5.8 |
| Drying | Drying temperature was 50° C. |

Then, the compounds used in Example 7 are shown below.

U-5

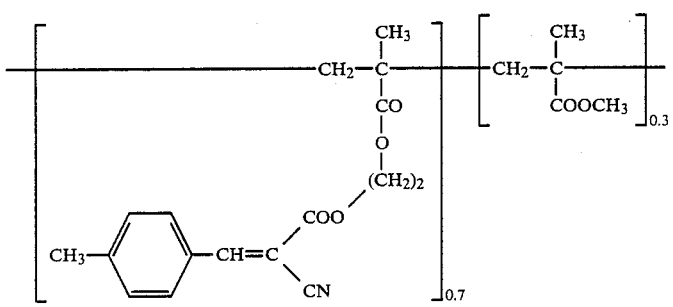

U-6

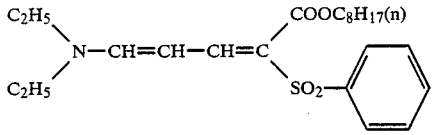

-continued
C-17
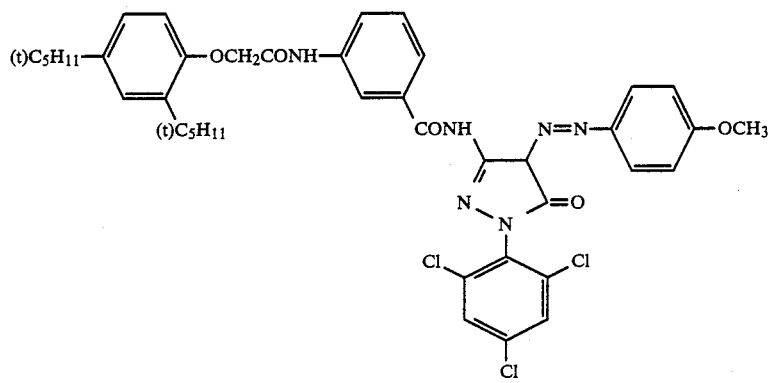
C-18
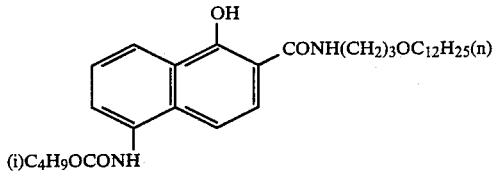
C-19
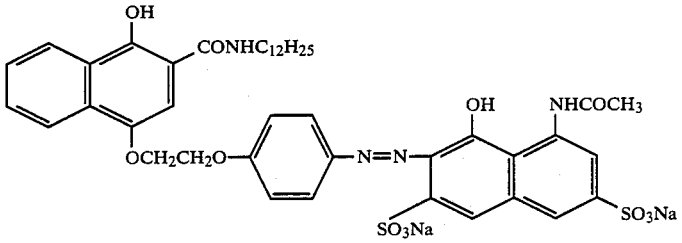
C-20
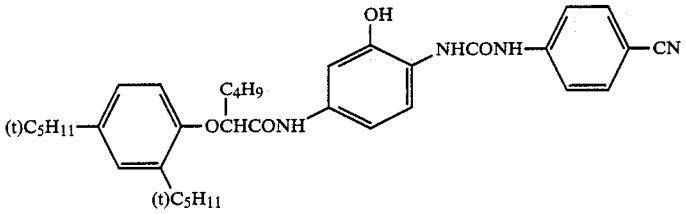
C-21
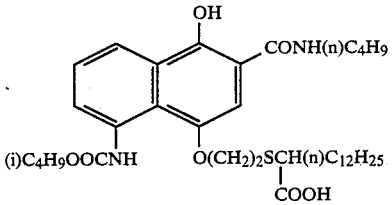
C-22
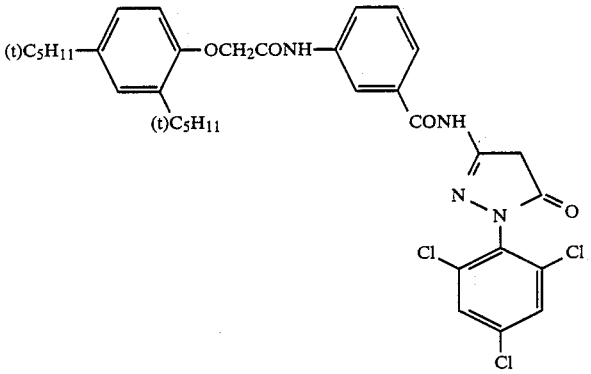

-continued
C-23
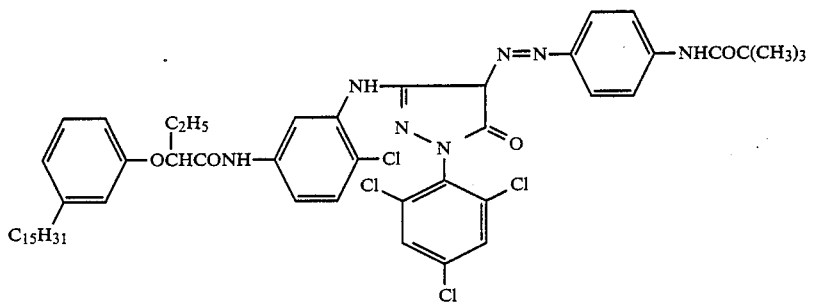
C-24
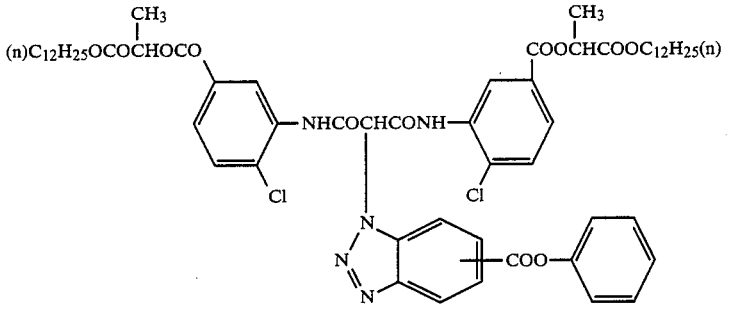
C-25
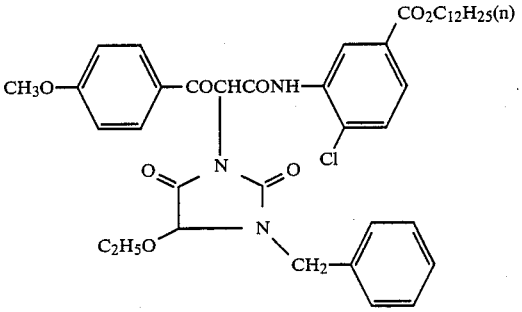
C-26
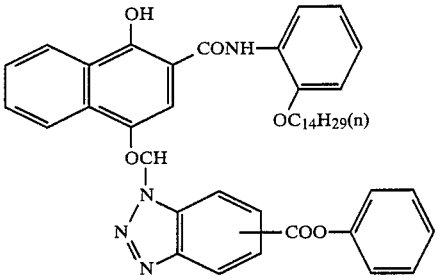
C-27
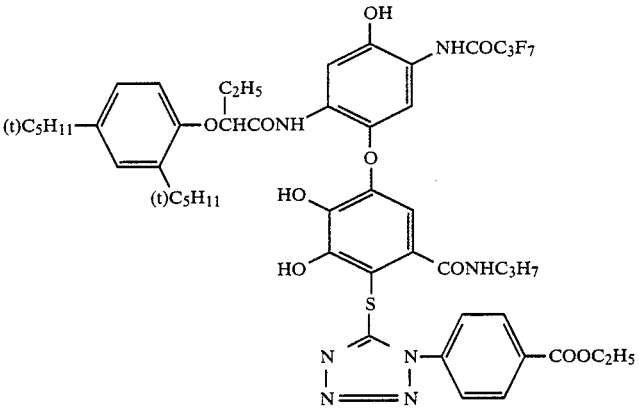

-continued
C-28
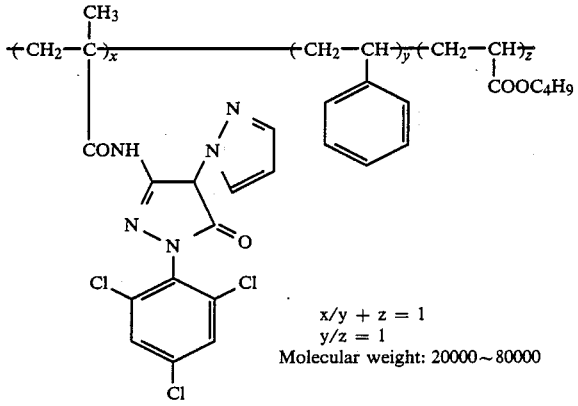
x/y + z = 1
y/z = 1
Molecular weight: 20000~80000
A-16
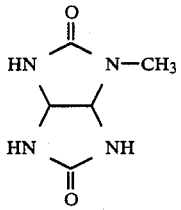
A-17
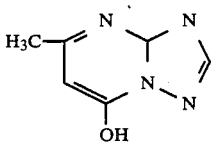
(S-5)
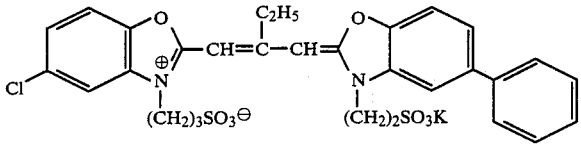
(S-6)
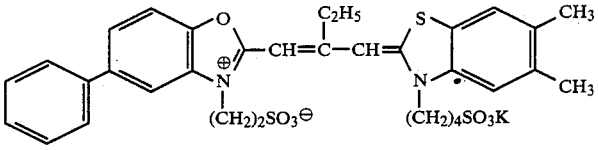
(S-7)
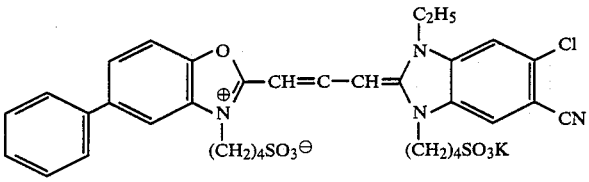
(S-8)
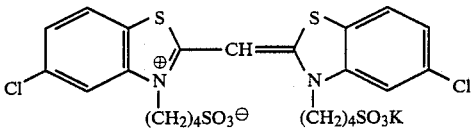
(S-9)
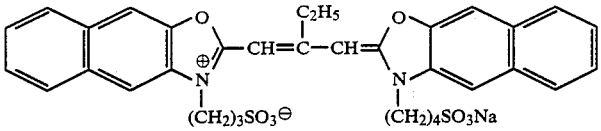

-continued (S-10)

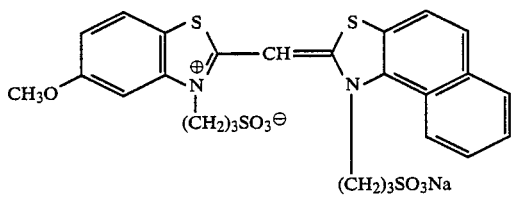

(S-11)

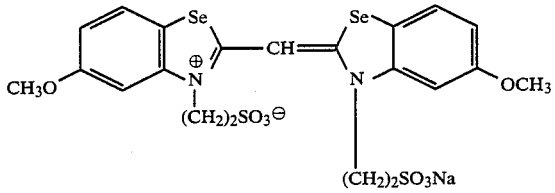

TABLE 7-2

| Sample No. | Relative Sensitivity | Fog | Note |
|---|---|---|---|
| 7-1 | 100 (standard) | 0.10 | Comparison |
| 7-2 | 120 | 0.11 | " |
| 7-3 | 102 | 0.11 | " |
| 7-4 | 288 | 0.10 | Invention |
| 7-5 | 316 | 0.10 | " |
| 7-6 | 282 | 0.12 | " |

From the results shown in Table 7-2, it can be seen that the samples which were spectrally sensitized using the combination of the sensitizing dyes in this invention show very high sensitivity as compared to the comparison samples.

Also, other photographic performance, such as the graininess, sharpness of the samples of this invention and the sensitivity and photographic properties of other emulsion layers (blue-sensitive layers and green-sensitive layers) were almost same as those of the comparison samples except that the sensitivity of the red-sensitive emulsion layer sensitized by the technique of this invention was greatly increased.

While the invention has been described in detail and with reference to specific examples thereof, it will be apparent to one skilled in the art that various changes and modifications can be made therein without departing from the spirit and scope thereof.

What is claimed is:

1. A silver halide photographic emulsion containing at least one compound represented by following formula (I):

Dye—L—Hyd (I)

wherein Dye represents a chromophore-containing dye residue shown by following formula (II); Hyd represents a hydrazine residue, one of the two nitrogen atoms of which is substituted by a carbonyl group, a sulfonyl group, a sulfoxy group, a phosphoryl group, or an alkylidene group and L represents a divalent linkage group of bonding Dye and Hyd;

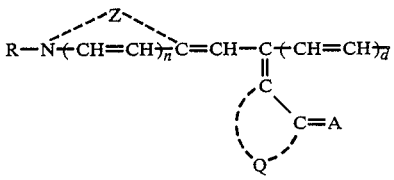

(II)

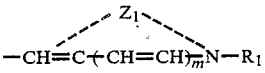

wherein R and $R_1$, which may be same or different, each represents an alkyl group; Z and $Z_1$, which may be the same or different, each represents an atomic group necessary for forming a 5- or 6-membered heterocyclic ring; Q represents an atomic group necessary for forming a 5- or 6-membered carbon ring or a 5- or 6-membered heterocyclic ring; A represents an oxygen atom or a sulfur atom; and n, d and m each represents 0 or 1.

2. The silver halide photographic emulsion of claim 1, wherein the emulsion further contain at least one compound represented by formula (III):

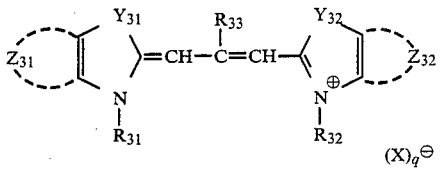

(III)

wherein $R_{31}$ and $R_{32}$, which may be the same or different, each represents an alkyl group; $R_{33}$ represents an alkyl group or an aryl group; $Z_{31}$ and $Z_{32}$, which may be the same or different, each represents an atomic group necessary for forming a benzene ring or a naphthalene ring; $Y_{31}$ and $Y_{32}$ each represents an oxygen atom, a sulfur atom, a selenium atom, or =N—$R_{34}$ wherein $R_{34}$ represents an alkyl group; X represents an acid residue; and q represents a number necessary for balancing the charges and when the compound of formula (III) forms an intramolecular salt, q is 0.

3. The silver halide photographic emulsion of claim 1, wherein in the dye residue shown by formula (II), at least one of Z and $Z^1$ is a naphtho[1,2-d]thiazole nucleus.

4. The silver halide photographic emulsion of claim 1, wherein the hydrazine residue shown by Hyd in formula (I) represents a phenylhydrazine residue.

5. The silver halide photographic emulsion of claim 1, wherein one of the two nitrogen atoms of the hydrazine residue shown by Hyd in formula (I) is substituted by a formyl group, an alkylcarbonyl group having from 1 to 5 carbon atoms, a benzoyl group, or an o-hydroxymethylbenzoyl group 6. The silver halide photographic emulsion of claim 4, wherein the hydrazine residue shown by Hyd in formula (1) is an N-formyl-N'-phenylhydrazine residue, an N-alkylcarbonyl-N'-phenylhydrazine residue, wherein the number of carbon atoms of the alkyl moiety is 4 or less, or an N-benzyl-N'-phenylhydrazine residue.

7. The silver halide photographic emulsion of claim 5, wherein the hydrazine residue shown by Hyd in formula (1) is an N-formyl-N'-phenylhydrazine residue, an N-alkylcarbonyl-N'-phenylhydrazine residue, wherein the number of carbon atoms of the alkyl moiety is 4 or less, or an N-benzoyl-N'-phenylhydrazine residue.

8. The silver halide photographic emulsion of claim 1, wherein Q of the dye residue shown by formula (II) is a barbituric acid derivative.

9. The silver halide photographic emulsion of claim 2, wherein in the compound shown by formula (III), $Y_{31}$ is a sulfur atom or a selenium atom.

10. The silver halide photographic emulsion of claim 1, wherein the amount of the dye shown by formula (I) is from $5\times10^{-7}$ to $5\times10^{-3}$ mol per mol of silver halide.

11. The silver halide photographic emulsion of claim 2, wherein the amount of the dye shown by formula (III) is from $5\times10^{7}$ to $5\times10^{-3}$ mol per mol of silver halide.

12. The silver halide photographic emulsion of claim 2, wherein the proportion of the compound shown by formula (I) to the compound shown by formula (III) is not more than an equimolar amount to the amount of the compound shown by formula (III).

13. The silver halide photographic emulsion of claim 12, wherein the proportion of the compound shown by formula (I) to the compound shown by formula (III) is from ½ to 1/150 mol to the amount of the compound shown by formula (III).

14. The silver halide photographic emulsion of claim 13, wherein the emulsion is spectrally sensitized by the compound shown by formula (I) and the compound shown by formula (III) at a ratio of from 1/50 to 1/3 mol.

* * * * *